United States Patent [19]

Molitor et al.

[11] 4,386,997

[45] Jun. 7, 1983

[54] MACHINE FOR BANDING A STACK OF ARTICLES

[75] Inventors: Edwin A. Molitor, Miami Township, Clermont County; Edward H. Scholefield, Wilmington, both of Ohio

[73] Assignee: Multifold-International, Inc., Milford, Ohio

[21] Appl. No.: 317,327

[22] Filed: Nov. 2, 1981

[51] Int. Cl.[3] ..... B65B 13/20

[52] U.S. Cl. ..... 156/443; 53/436; 53/528; 53/586; 53/590; 53/591; 100/8; 100/33 R; 156/468; 156/486

[58] Field of Search ..... 100/10, 17, 20, 23; 53/580, 586, 590, 591, 436, 419, 523, 526, 528; 156/475, 443, 468, 552

[56] References Cited

U.S. PATENT DOCUMENTS

| | | | |
|---|---|---|---|
| 2,842,915 | 7/1958 | Howatt | 53/586 X |
| 2,975,571 | 3/1961 | Aronson et al. | 53/586 X |
| 3,307,326 | 3/1967 | Krebs | 53/586 |
| 4,250,692 | 2/1981 | Uchida | 53/586 X |

*Primary Examiner*—David A. Simmons

*Attorney, Agent, or Firm*—James W. Pearce; Roy F. Schaeperklaus

[57] ABSTRACT

A machine for wrapping a band around a stack of flat articles. A band guiding assembly and a clamp assembly are at a banding station. An end portion of a strip of banding material is advanced from the band guiding assembly to the clamp assembly, and a clamp mounted on the clamp assembly closes an end portion of the strip of banding material. The clamp assembly is separated from the band guiding assembly to provide an exposed section of the strip of banding material. The stack is advanced against the exposed section of the strip of banding material to draw the banding material around three sides of the stack. The section of the strip of banding material at the stack is cut to provide a second end portion for overlapping the first mentioned end portion. Glue is deposited on one of the end portions in position for overlapping by the other end portion. A pair of hand members advance adjacent the fourth side of the stack and against the first and second end portions to fold the end portions to overlying relation with the glue therebetween. Presser members compress the stack while the banding material is wrapped around the stack and while the glue sets.

4 Claims, 33 Drawing Figures

MACHINE FOR BANDING A STACK OF ARTICLES

This invention relates to a machine for wrapping a band around a stack of articles.

An object of this invention is to provide a machine which draws a wrapping band across the path of a stack of articles and then advances the stack against the wrapping band to cause the wrapping band to surround three sides of the stack.

A further object of this invention is to provide such a machine which disposes glue on the wrapping band and severs a length of the band for wrapping around the stack.

A further object of this invention is to provide such a machine in which hand members advance end portions of the length across a remaining side of the stack and hold the end portions in overlying relation so that the glue can set to hold the wrapping band in position surrounding the stack of articles.

A further object of this invention is to provide such a machine in which means is provided for compressing the stack while the band is being wrapped around the stack and while the glue sets on the band.

A further object of this invention is to provide such a machine in which the compressing means include a plurality of pressing elements which act when the stack is advanced from an input station to the banding station, while the stack is at the banding station, and while the stack is being discharged from the banding station.

Briefly, this invention provides a machine which draws a wrapping band across the path of advance of a stack of articles. The stack is advanced against the wrapping band while an end portion of the wrapping band is held by a clamp to cause a section of the wrapping band to surround three sides of the stack. The section of the wrapping band is cut from the remainder of the wrapping band to provide a second end portion for overlapping the first end portion. A slug of glue is positioned on one of the end portions of the section of the wrapping band, and the clamp is released. Then, hand members advance the end portions of the wrapping band to overlap on a remaining side of the stack. The hand members complete folding of the end portions of the length against the stack to be held by the glue. Pressure members compress the stack as the band is wrapped thereon and as the glue sets, a fresh free end of the wrapping band is caught by the clamp to prepare the machine for a subsequent cycle.

DESCRIPTION OF DRAWINGS

The above and other objects and features of the invention will be apparent to those skilled in the art to which this invention pertains from the following detailed description and the drawings in which.

In the following detailed description and the drawings, like reference characters indicate like parts.

GENERAL DESCRIPTION

Figure 1:
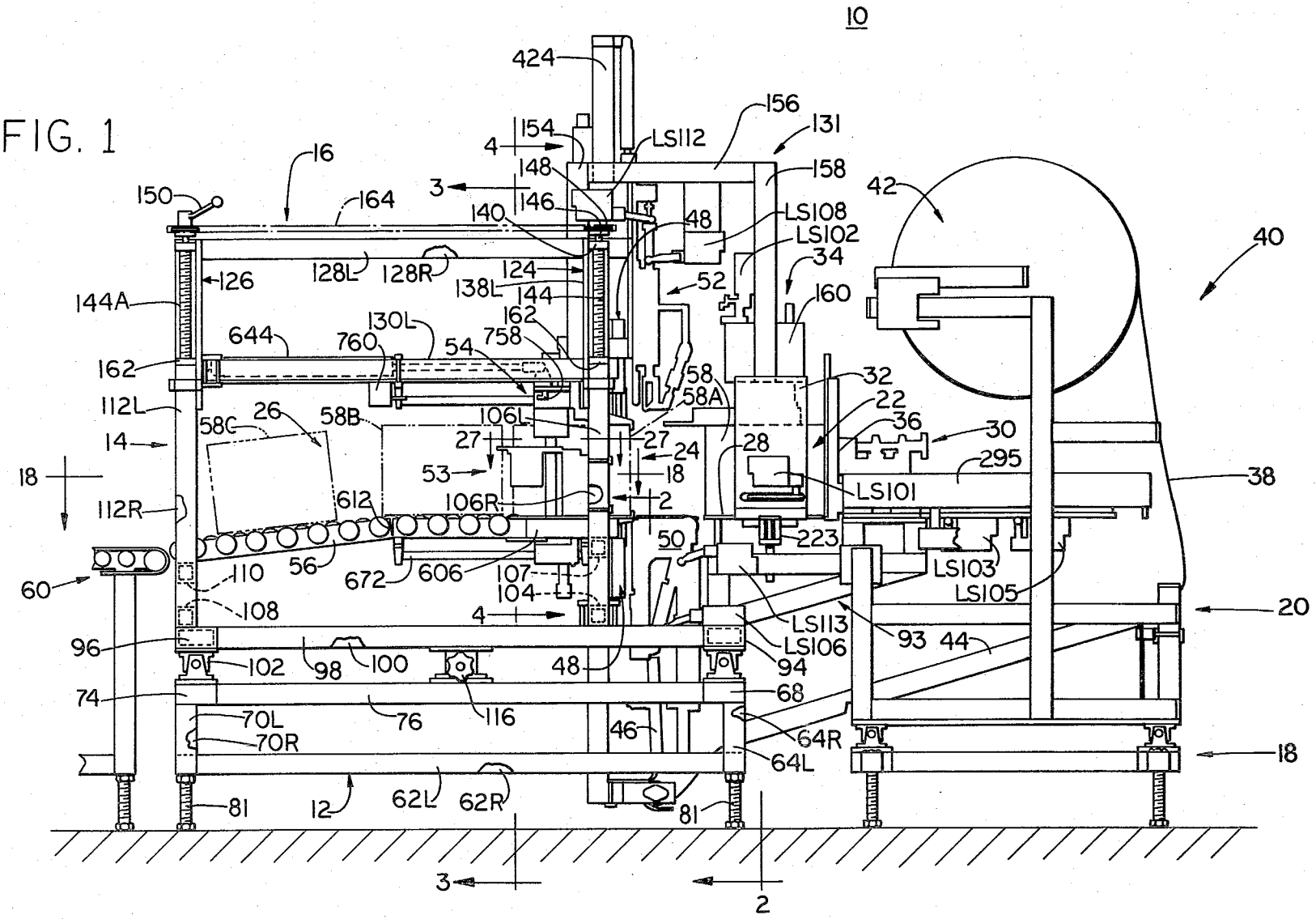
FIG. 1 is a somewhat schematic view in side elevation of a bundle banding machine constructed in accordance with an embodiment of this invention showing the major structure of the machine and the relative placement of subassemblies thereupon.

FIG. 1 shows a bundle banding machine 10 which is constructed in accordance with an embodiment of this invention. The frame of the bundle banding machine 10 is comprised of a base frame 12, a lateral adjustment frame 14, a vertical adjustment frame 16, a paper feed base frame 18 and a paper feed lateral adjustment frame 20. The bundle banding machine 10 also includes an input station 22, a banding station 24, and an output assembly 26. The input station 22 of the bundle banding machine 10 is comprised of an input table assembly 28, an input guide assembly 30, a stop assembly 32, a primary compressor 34, and a pusher assembly 36. The banding station 24 is provided with a continuous supply of a banding paper 38 from a paper handling assembly 40. The paper handling assembly 40 is comprised of a roll stand 42, a sloping paper guide 44, and an upright paper guide 46. The banding station 24 is comprised of a secondary compressor assembly 48, a lower paper handling assembly 50, an upper paper handling assembly 52, and a backstop assembly 53. The output assembly 26 is comprised of an extraction assembly 54 and a discharge roll conveyor 56.

A definition of logistical terms is now in order. The reader, in viewing FIG. 1, is looking at the left side or the operator side of the bundle banding machine 10. In general, the right side of the figure is the input end of the machine, and the left side of the figure is the output end thereof. A horizontal line extending from end to end of the machine will henceforth be known as the longitudinal direction, and the lateral direction is defined as horizontally perpendicular to the longitudinal direction. The input face or side of any element is defined as that side facing the input end of the machine, and similarly the output face of any element faces the output end of the machine.

Figure 20:
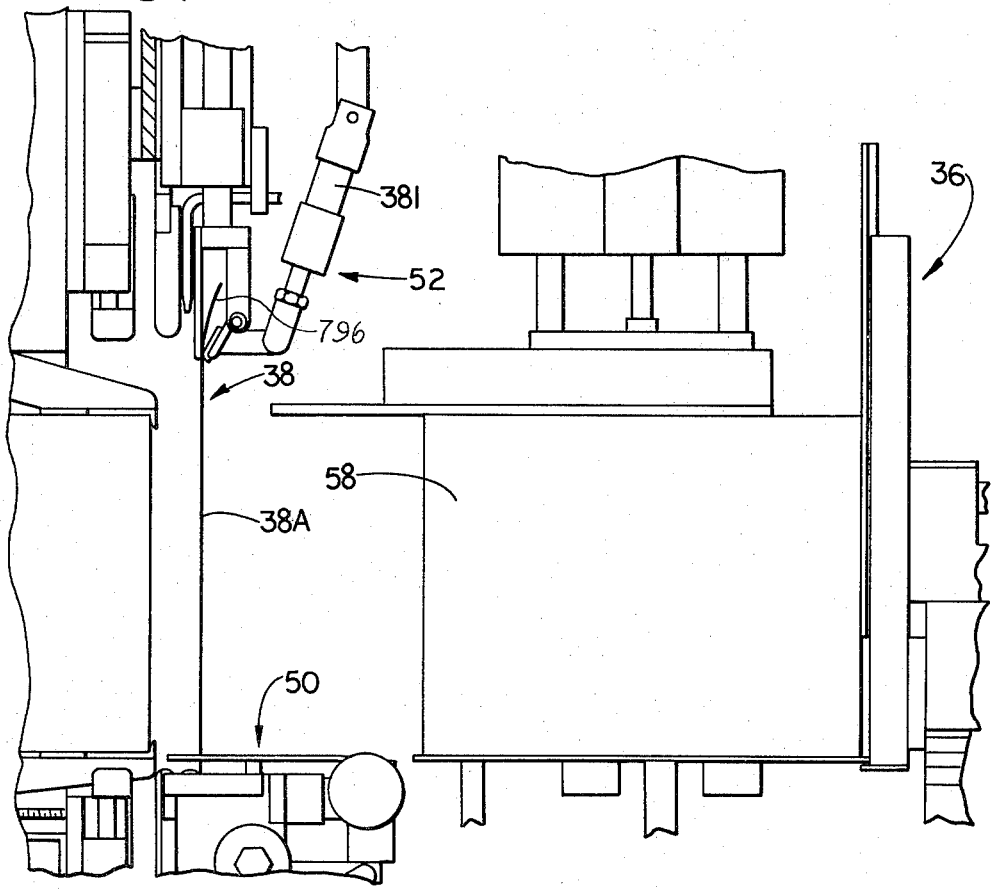
Figure 21:
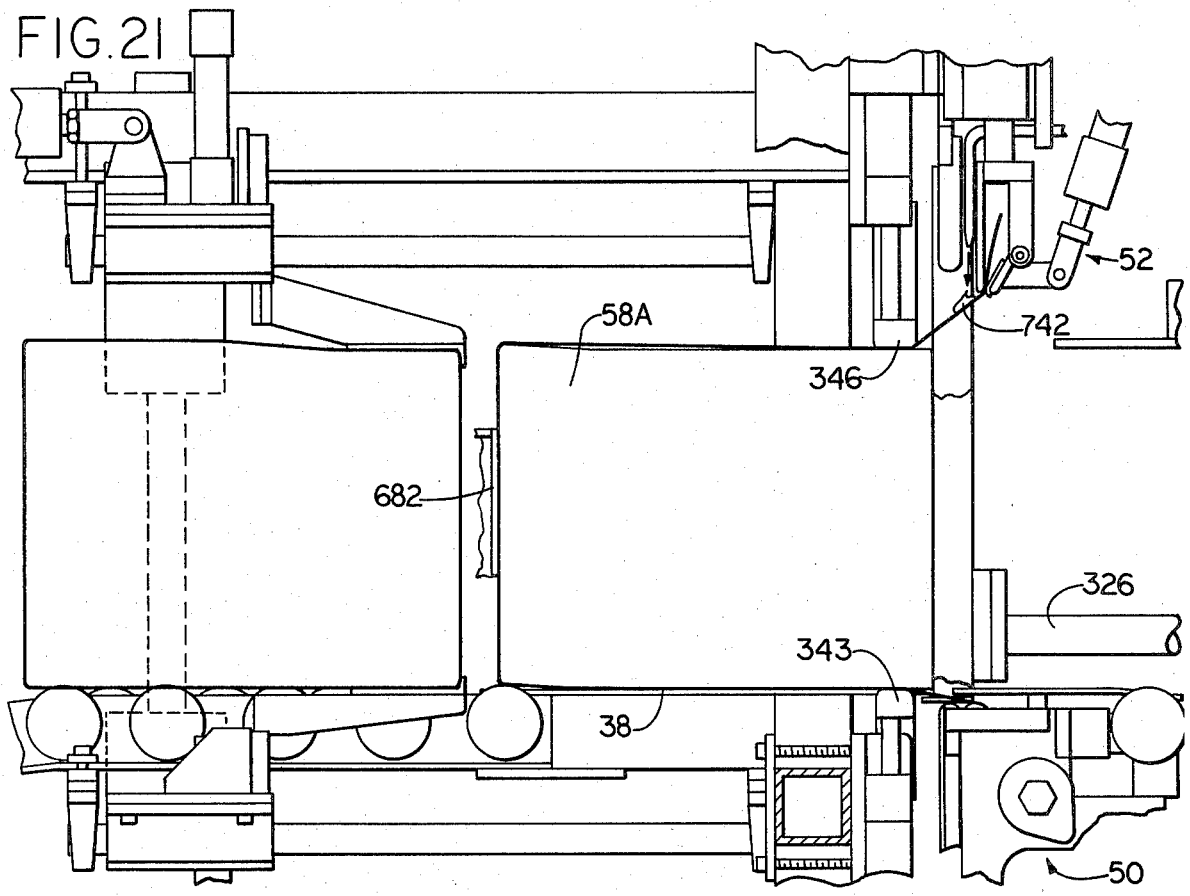
Figure 23:
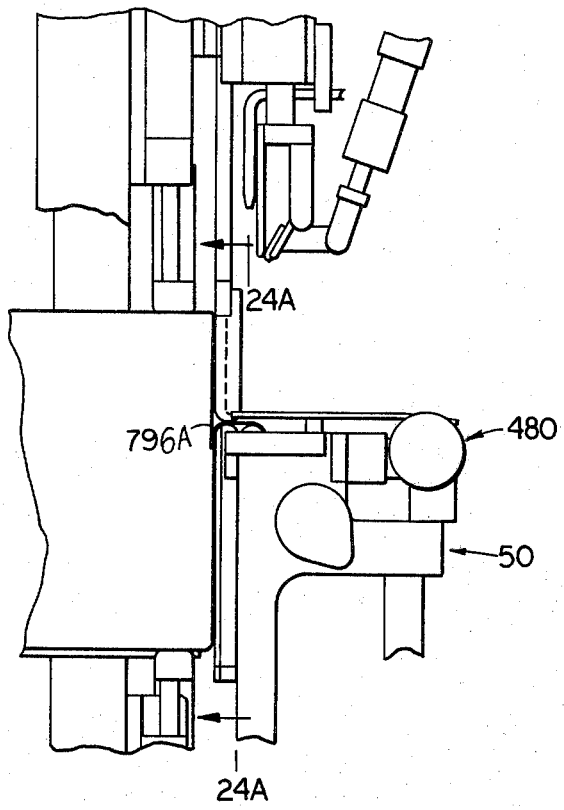

A stack of cartons 58 containing a predetermined number of cartons, is placed within the input station 22 of the bundle banding machine 10, either manually or automatically. In most instances, this machine will be utilized in conjunction with other high speed carton processing equipment. Therefore, the automatic insertion of the stack of cartons 58 will take precedence in this discussion. In this respect, the right side of the bundle banding machine 10 is placed across the output station of a stack forming machine (not shown) in such alignment that the output of the stack forming machine cooperates with the input station 22. As the stack of cartons 58 is ejected from the stack forming machine, it moves laterally to the left of the bundle banding machine 10 until the centerline of the stack of cartons 58 coincides with an operating centerline 59 of the bundle banding machine 10 shown in a dot-dash line in FIG. 18. When the stack of cartons 58 is in proper position a limit switch LS101 is actuated, as will be explained hereinafter to cause the pusher assembly 36 to move the stack longitudinally from the input station until its trailing edge is in vertical alignment with the banding station 24, shown as 58A in FIG. 1. The leading edge of the stack of cartons 58 moves into a vertically disposed portion 38A (see FIGS. 20 and 21) of the banding paper 38, being held uprightly by the upper paper handling assembly 52. Since the upper paper handling assembly 52 has a non-slip hold on the end of the banding paper 38, continued movement of the stack of cartons 58 causes more banding paper to feed through the lower paper handling assembly 50. When the stack halts, banding paper has been stretched around three sides of the stack of cartons 58A as shown in FIG. 21. The secondary compressor assembly 48 is engaged. Subsequently, the upper paper handling assembly 52 deposits a portion of fast drying glue on the outside surface of the upper extremity of the banding paper 38. The upper paper handling assembly 52 releases the paper and disposes it vertically downward by mechanical means along the trailing surface of the stack of cartons 58. The lower paper handling assembly 50 ascends to within close proximity of the now free end of the upper extremity of the banding paper 38 as shown in FIG. 23, feeding a further portion of the banding paper 38 upwardly along the trailing surface of the stack of cartons 58. The banding paper 38 is severed within the lower paper handling assembly 50, and the now free lower end of the banding paper 38 is mechanically flipped upwardly over the glued portion of its upper extremity and is compressively held in place for such time to accomplish a bond.

When the bundle has been banded at the position 58A, the extraction assembly 54 moves the banded bundle to a position 58B and releases the bundle. The bundle previously occupying the position 58B is pushed to a position 58C where gravity motivates it onto a customer conveyor 60 for further processing.

The machine which has been described in general terms will now be described in detail.

FRAME

Referring to FIGS. 1, 2, 3 and 8, the base frame 12 is comprised of a pair of bottom stringers 62L and 62R, a pair of input posts 64L and 64R, a lower input lateral brace 66, an upper input lateral member 68, a pair of output posts 70L and 70R, an output lower lateral brace 72, an upper output lateral member 74, and an upper longitudinal stringer 76.

Figure 3:
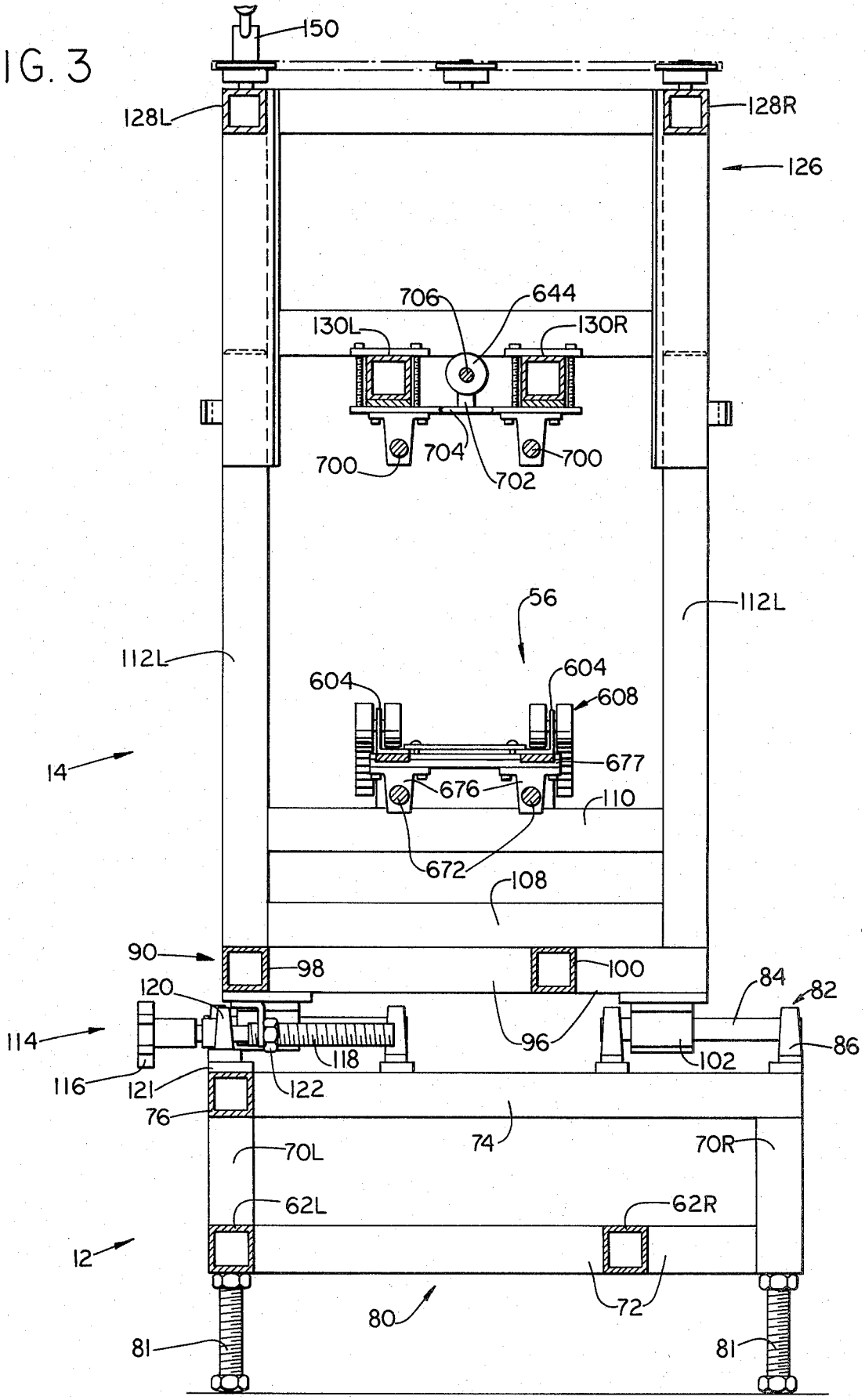
FIG. 3 is a view in upright section taken along the line 3—3 in FIG. 1 showing an output end of the machine.

The lower input lateral brace 66 determines the lateral spaced relationship of the pair of input posts 64L and 64R. The output lateral brace 72 determines the lateral spaced relationship of the pair of output posts 70L and 70R. It is to be noted that the lateral spacing of the pair of output posts 70L and 70R is greater than that of the input posts 64L and 64R. The input lateral member 68 is rigidly affixed across the top ends of the pair of input posts 64L and 64R so that it is flush with the post 64L and overhangs the post 64R as indicated at 78. The output lateral member 74 is rigidly affixed across the top extremities of the output posts 70L and 70R and is flush therewith at both ends. The pair of bottom stringers 62L and 62R and the longitudinal stringer 76 rigidly affix the input lateral member 68 and the output lateral member 74 in longitudinal and parallel spaced relationship. The bottom stringer 62R is rigidly affixed to the output lateral brace 72 approximate the right end thereof as is shown in FIG. 3. Adjustable support assemblies 81 support the base frame 12.

The base frame 12 is provided with a set of four bearing rod assemblies 82. The bearing assemblies 82 are fixedly attached adjacent the ends of the input and output lateral members 68 and 74 respectively. Each set of bearing rod assemblies 82 is comprised of a bearing rod 84 and a pair of rod mounts 86.

The lateral adjustment frame 14 is shown in FIGS. 1, 2, 3, 18 and 26 and is comprised of a subframe assembly 88, an input frame 90, an output frame 92, and an auxiliary frame 93. The subframe assembly 88 is comprised of an input carriage member 94, and an output carriage member 96 that are fixedly held in longitudinal and parallel spaced relationship at their left extremities by a longitudinal carriage member 98. A secondary carriage member 100 is rigidly affixed to the input face of and somewhat inboard of the right end of the output carriage member 96 and extends toward the input end of the assembly in a substantially cantilever construction. The subframe assembly 88 is provided with a set of four linear bearings 102 rigidly affixed to the underside extremities of the input and output carriage members 94 and 96 respectively.

The input frame 90 is comprised of a base lateral member 104, a pair of input uprights 106L and 106R, and a middle lateral member 107. The base and middle lateral members 104 and 107 respectively provide parallel and lateral spaced relationship for the pair of input uprights 106L and 106R. The input frame 90 is rigidly affixed in lateral disposition across the top surfaces of the longitudinal and secondary carriage members 98 and 100 respectively. The base lateral member 104 is mounted at the input end of the shorter secondary carriage member 100.

The output frame 92 is comprised of a base output lateral member 108, an output brace 110, and a pair of output uprights 112L and 112R. The output frame 92 is rigidly mounted on the subframe assembly 88 with the base output lateral member 108 immediately above a portion of the output carriage member 96. The height of the output brace 110 is lower than the height of the lateral member 107. The output frame 92 extends across the output extremity of the subframe assembly 88.

Figure 5:
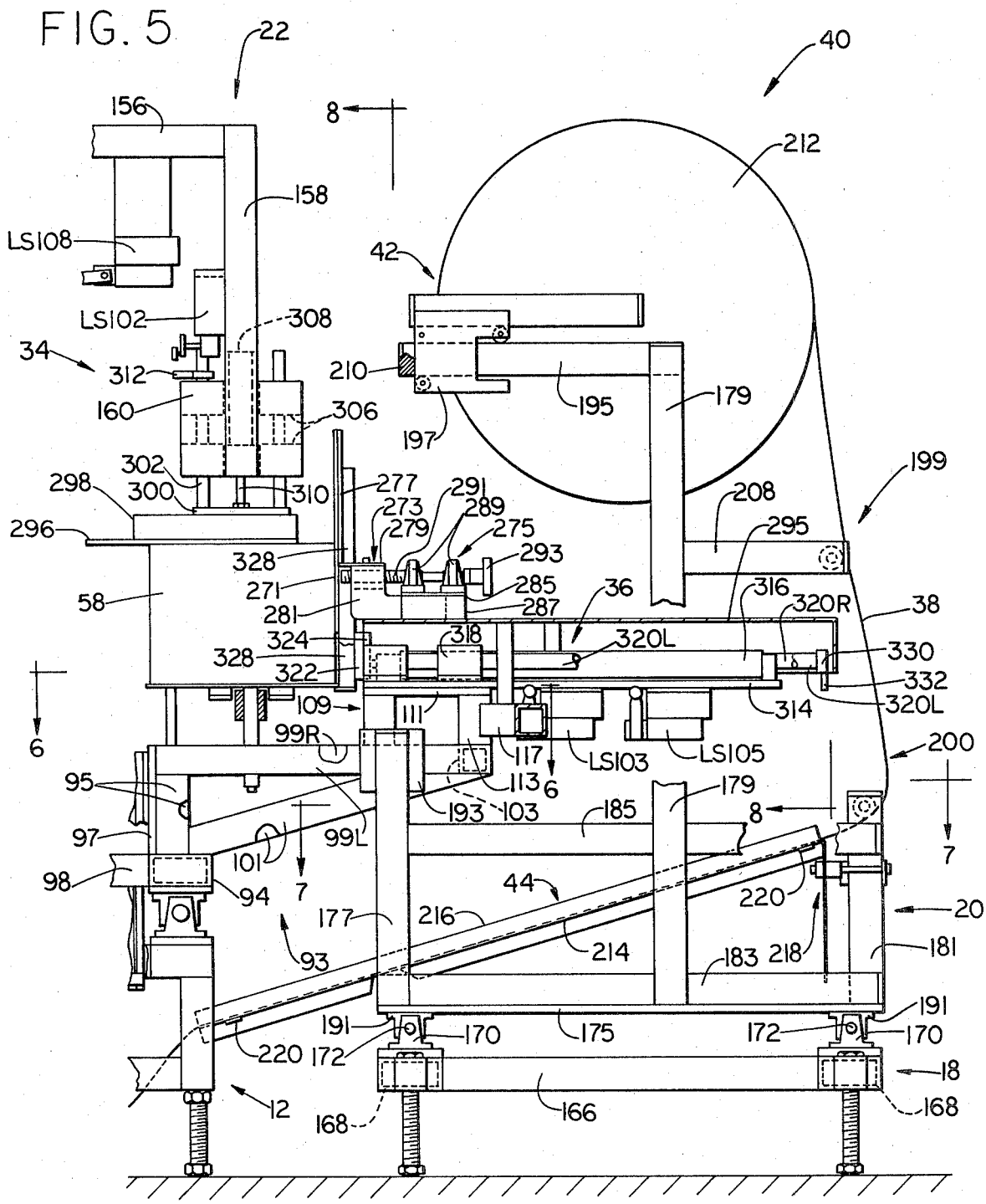
FIG. 5 is an enlarged view in side elevation showing an input section and paper handling portions of the bundle banding machine, portions being cut away for clarity.
Figure 6:
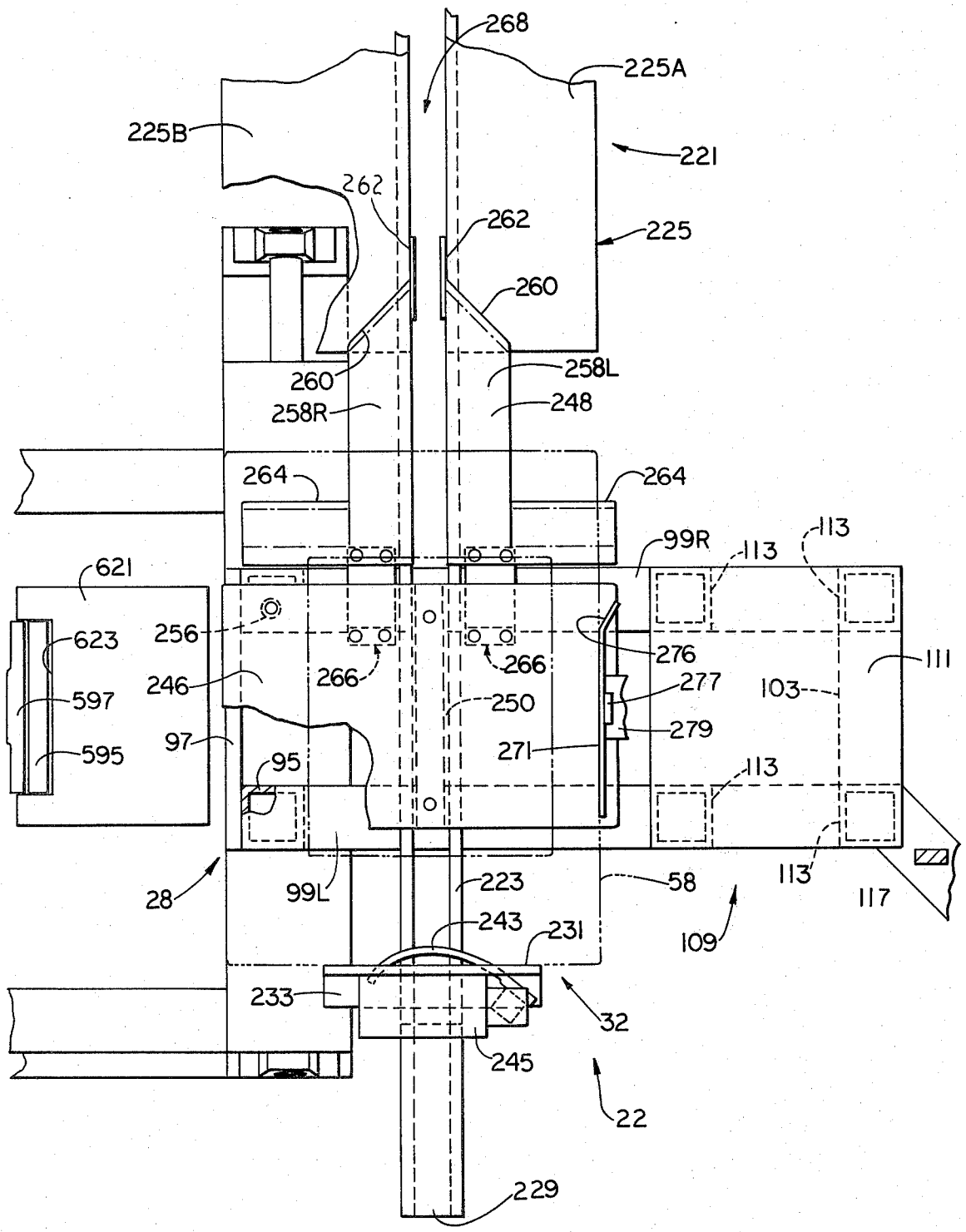
FIG. 6 is a plan view of the input section of the machine taken along the line 6—6 in FIG. 5, pieces being cut away to expose otherwise hidden mechanical details.

Referring now to FIGS. 5 and 6, the auxiliary frame 93 is comprised of a pair of upright posts 95, a face plate 97, a pair of horizontal members 99L and 99R, a pair of brace members 101, and a lateral brace 103. The face plate 97 is rigidly affixed across the output face of the pair of upright posts 95. The posts 95, in turn, are rigidly affixed to the top surface of the input carriage member 94 of the lateral adjustment frame 14, in such position that the output faces of the face plate 97 and the input carriage member 94 are flush with each other. The horizontal members 99L and 99R are rigidly affixed at their output ends to the top extremities of the upright posts 95 and to the input face of the face plate 97. The input ends of the horizontal members 99L and 99R are supported against vertical displacement by the diagonally disposed pair of brace members 101. The members 101 are rigidly affixed to the upright posts 95 and to the input carriage member 94. Output ends of the horizontal members 99L and 99R are attached to the face plate 97. The input ends of the horizontal members 99L and 99R are restrained against lateral displacement by the lateral brace 103 rigidly affixed therebetween.

The auxiliary frame 93 also incorporates a pusher standoff table 109 that is comprised of a substantially square plate 111 and a set of four tubular standoffs 113. The four tubular standoffs 113 are rigidly affixed to the underside of and at the corners of the square plate 111 to form a table-like arrangement that is in turn rigidly affixed to the top surfaces of the horizontal members 99L and 99R. A control panel mounting bar 117 is rigidly affixed to the left hand input member of the set of four tubular standoffs 113. The control bar 117 is horizontally disposed, but angles outwardly to the left side of the bundle banding machine 10 in such manner so as to dispose the control panel (not shown) in a convenient location for the operator who normally stands at the input station 22.

The set of four linear bearings 102 of the lateral adjustment frame 14 cooperate with the bearing rods 84 of the base frame 12 to provide lateral movement of the lateral adjustment frame 14 upon the base frame 12. This lateral movement is restrained and controlled by a hand screw assembly 114. The hand screw assembly 114 is comprised of a handle 116 (FIG. 3), a shaft 118, a bearing 120, and a nut bracket 122. The shaft 118 is partially threaded. The clear end of the shaft 118 is rotatably mounted through the inner race of the bearing 120, the handle 116 being affixed to the outboard end thereof. The threaded portion of the shaft 118 extends inwardly to threadably cooperate with the nut bracket 112. The bearing 120 is fixedly and spacedly affixed to and above the longitudinal stringer 76 of the base frame 12 by means of an appropriate mounting block 121. The nut bracket 122 is likewise affixed to the underside of the longitudinal carriage member 98 of the lateral adjustment frame 14. By manual rotation of the handle 116, the lateral adjustment frame 14 can be placed and held at any desired position within the travel limits of the bearing rod assemblies 82 of the base frame 12. This unitary adjustment suffices to configure the entire machine for processing bundles of various widths as will be further discussed hereinafter.

The vertical adjustment frame 16 (FIGS. 1, 3, 14 and 25) is comprised of an upper input frame 124, an upper output frame 126, a pair of top stringers 128L and 128R, a pair of lower stringers 130L and 130R, and a compressor mount frame 131. The upper input frame 124 (FIG. 4) is comprised of an upper input lateral tube 132, a lower input lateral tube 134, a pair of lateral guide plates 136L and 136R, and a pair of longitudinal guide plates 138L and 138R. Top portions of the lateral guide plates 136L and 136R are rigidly affixed to the ends of the upper input lateral tube 132. The input lateral tube 134 is rigidly affixed between the lateral guide plates 136L and 136R in a similar manner. Each of the longitudinal guide plates 138L and 138R is rigidly affixed to the output edge of one of the lateral guide plates 136L and 136R, and extends outboardly from and at right angles thereto.

Within the angle formed by the lateral and longitudinal guide plates 136L and 138L respectively, and very near the top thereof, is rigidly affixed a bearing block 140 (FIG. 1). A vertically disposed screw 144, rigidly incorporates a clear shaft extension 146 of smaller diameter, the clear shaft extension being rotatably mounted within the bearing block 140 while the upper extremity or shoulder of the screw 144 is itself thrust mounted by gravity within the block 140. A chain sprocket 148 is fixedly attached to the upper extremity of the shaft extension 146 of the screw 144. Referring again to FIG. 4, the right side of the upper output frame 126 is also provided with a similar assemblage of screw, mount, and sprocket 148A as the left side first described. A takeup sprocket 152 is rotatably mounted at the center of the upper input lateral tube 132 to complete the upper input frame 124.

Figure 4:
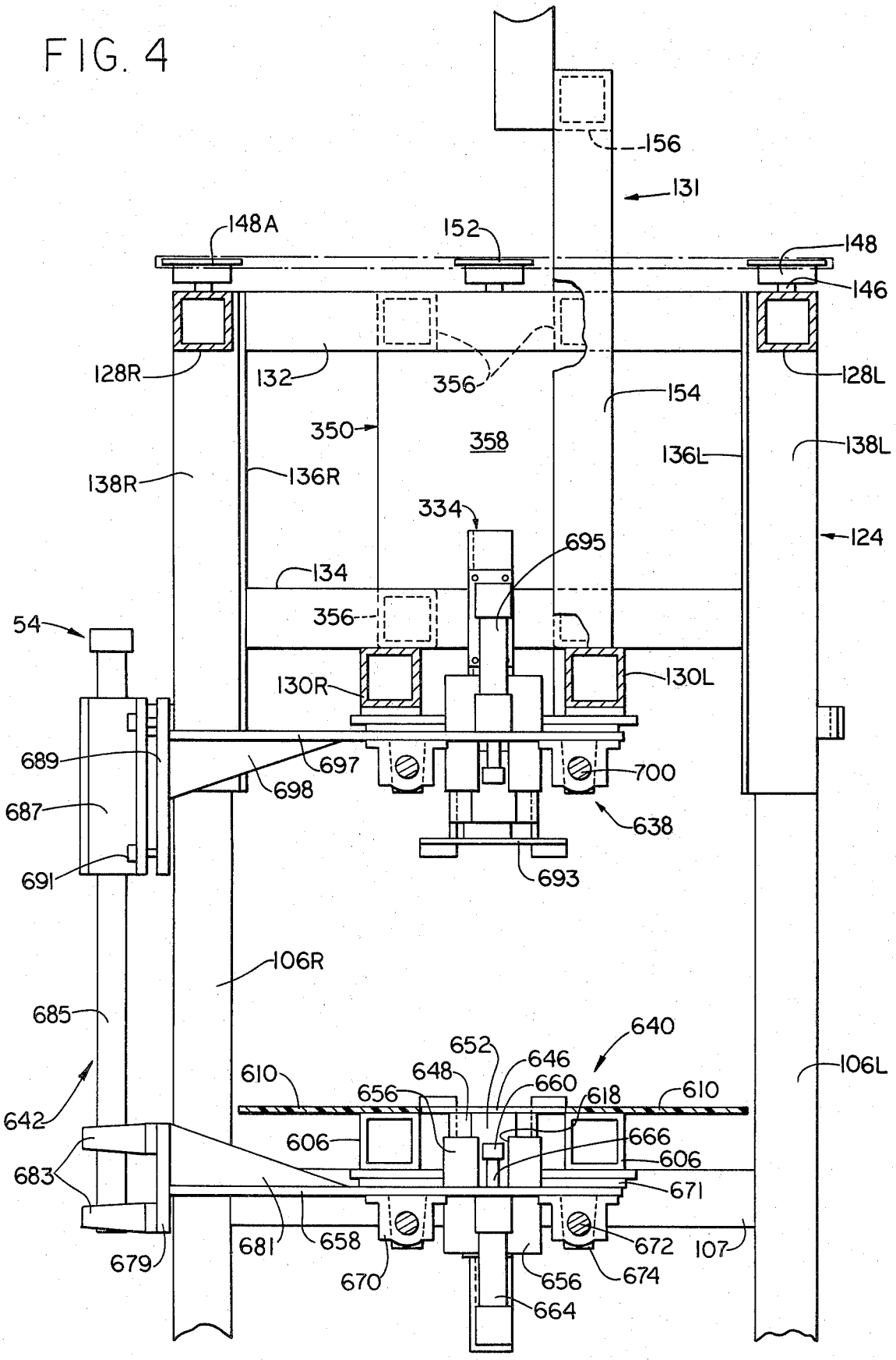
FIG. 4 is a view in upright section taken along the line 4—4 in FIG. 1 showing mechanism which removes bundles of cartons from the bundle banding machine.

The upper output frame 126 (FIG. 1) is generally similar to the upper input frame 124 except for the addition of a crank handle 150 to the shaft of a screw 144A and that the assemblies are opposedly mounted with respect to each other to form a cooperating pair, similar numbers being used on like parts. The upper input and output frames 124 and 126 respectively are rigidly held in longitudinal spaced relationship by the pair of top stringers 128L and 128R and the pair of lower stringers 130L and 130R. As shown in FIGS. 3 and 4, the top stringers 128L and 128R are rigidly affixed to the upper input and output frames 124 and 126 at the upper outboard extremities of the longitudinal guide plates 138L and 138R. The lower stringers 130L and 130R are rigidly affixed to the underside of the lateral tubes 134 and laterally spaced inboard to provide mounting for further assemblies.

The compressor mount frame 131 is comprised of a vertical riser 154, a horizontal member 156, a vertical post 158, and a compressor mount plate 160. Referring to FIG. 4, the vertical riser 154 is rigidly affixed at its bottom end portion across the output surface of the input lateral tube 134. It is located slightly to the left side of centerline, almost directly above the left hand lower stringer 130L. The vertical riser 154 stands uprightly being rigidly affixed across the output surface of the upper input lateral tube 132. The output extremity of the horizontal member 156 is rigidly affixed in cantilever form at the top end of and to the input surface of the vertical riser 154. Rigidly affixed in hanging disposition to the input extremity of the horizontal member 156 is the vertical post 158. The compressor mount plate 160 is rigidly affixed to the lower inner surface of the vertical post 158, and is centered thereupon.

The vertically disposed screws 144 of the vertical adjustment frame 16 threadably cooperate with a set of four threaded blocks 162. The blocks 162 are rigidly affixed to the top extremities of the pairs of input and output uprights 106L and 106R and 112L and 112R, respectively, of the lateral adjustment frame 14. A chain 164 circumscribes the chain sprockets 148 of the vertical adjustment frame 16 in such manner, so that when the crank handle 150 is rotated, the screws 144 are turned in unison, causing the vertical adjustment frame 16 to be raised or lowered. The pairs of input and output uprights 106L and 106R and 112L and 112R, respectively, of the lateral adjustment frame 14 are rigidly assembled to cooperate with the pairs of lateral and longitudinal guide plates 136L and 136R and 138L and 138R of the vertical adjustment frame 16, to maintain alignment and rigidity between these two major assemblies. As can be seen, all subassemblies attached to the vertical adjustment frame 16 are adjustable in vertical placement by means of the single crank handle 150, to cooperate with bundles of different height.

In combination then, the handle 116 of the lateral adjustment frame 14 and the crank handle 150 of the vertical adjustment frame 16, suffice to permit an operator to reconfigure the bundle banding machine 10 to handle stacks of cartons 58 of different width and height.

Figure 7:
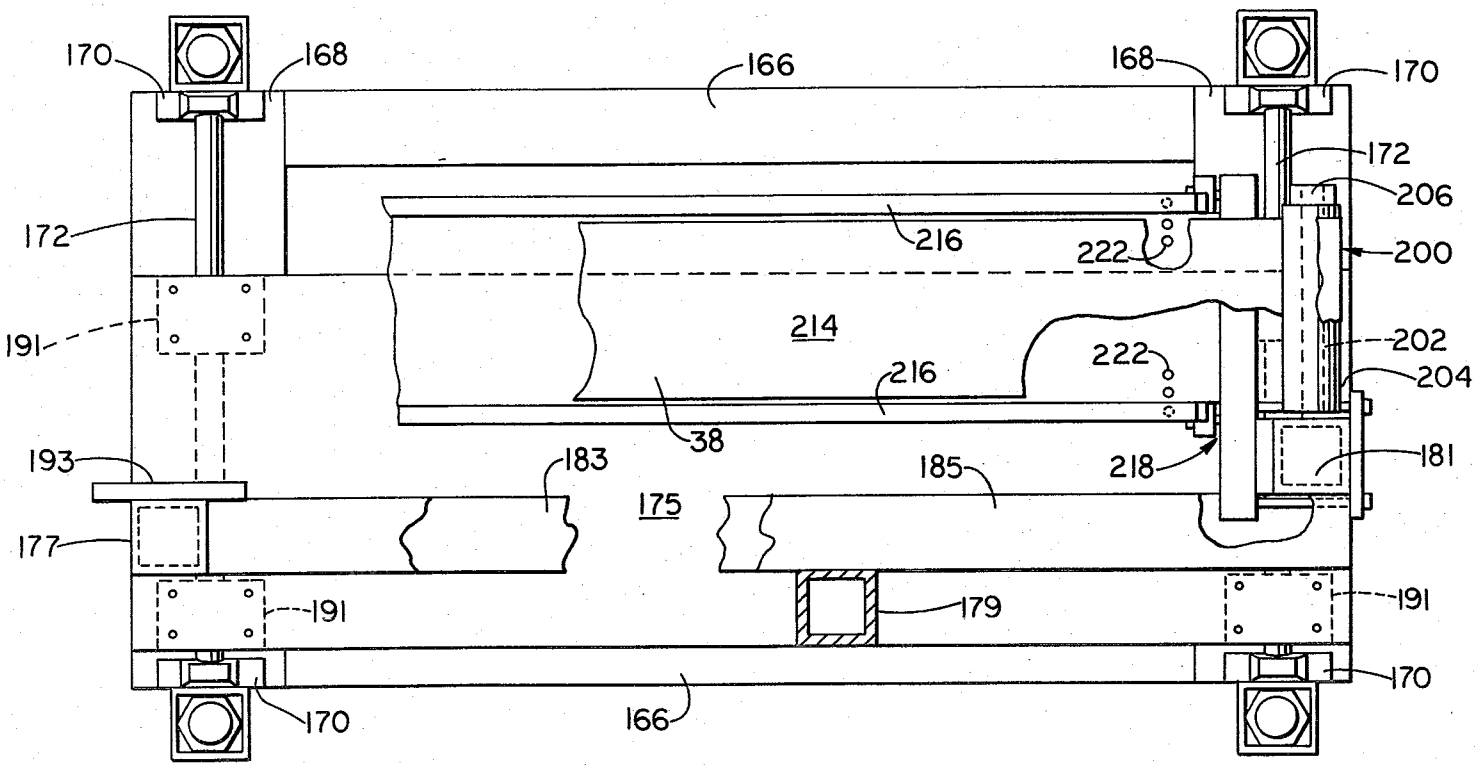
FIG. 7 is a plan view of the paper handling portion taken generally along a line 7—7 in FIG. 5.

The paper feed base frame 18 and the paper feed lateral adjustment frame 20 are best shown in FIGS. 5 and 7. The paper feed base frame 18 is comprised of a pair of base stringers 166 and a pair of lateral tubes 168. The base stringers 166 are rigidly affixed between the end portions of the lateral tubes 168 to form a simple rectangular frame. At each end of the pair of lateral tubes 168 is fixedly mounted a rod holder 170. The rod holders 170 cooperate to fixedly retain a pair of bearing rods 172. It should be noted that the bearing rods 172 are the same length as the lateral tubes 168 and thereby laterally span the paper feed base frame 18.

The paper feed lateral adjustment frame 20 incorporates a base plate 175, an output upright 177, a middle upright 179, an input upright 181, a base tube 183, and an upright stabilizer 185. The base tube 183 is rigidly affixed in the lengthwise direction upon the top surface of the base plate 175 and laterally located to the left side thereof to yield a rigid mounting structure for the output, middle, and input uprights 177, 179, and 181 respectively. Firstly then, the output upright 177 is rigidly affixed at its bottom extremity to the top of the base plate 175 and at its bottom input face to the output extremity of the base tube 183. The middle upright 179 is rigidly affixed at its lower extremity to the top surface of the base plate 175 and at its bottom right hand face to the left hand face of the base tube 183, being longitudinally located at approximately the center of the base tube 183. The input upright 181 is rigidly affixed at its bottom extremity to the base plate 175 and at its lower left hand surface to the input most right hand surface of the base tube 183. In identical manner, the upright stabilizer 185 is rigidly affixed to the output, middle and input uprights 177, 179, and 181, respectively, but at an elevated position, to provide substantial stability to the paper feed lateral adjustment frame 20.

The base plate 175 of the paper feed lateral adjustment frame 20 is fixedly provided with a set of four linear bearings 191, located on the underside thereof, to cooperate with the pair of bearing rods 172 of the paper feed base frame 18. This provides ample lateral displacement of the paper feed lateral adjustment frame 20 with respect to the paper feed base frame 18 to cooperate with the lateral movement of the lateral adjustment frame 18 with respect to its base frame 12. An attachment flange 193 is rigidly affixed to the right hand surface of the output upright 177 of the paper feed lateral adjustment frame 20. The attachment flange 193 is attached to the left side of the auxiliary frame 93 of the lateral adjustment frame 14 to cause the paper feed lateral adjustment frame 20 to follow the lateral settings of the lateral adjustment frame 14 of the bundle banding machine 10. In this way, the handle 20 remains the only width adjustment for the bundle banding machine 10.

Paper Handling Assembly

The paper handling assembly 40, is shown in FIGS. 5 and 7 and is comprised of the roll stand 42 and, the sloping paper guide 44. The roll stand 42 is comprised of the middle upright 179 of the paper feed lateral adjustment frame 20, a top longitudinal bar 195, a movable pivot assembly 197, a first paper guide 199, and a second paper guide 200.

The second paper guide 200 (FIG. 7) is further comprised of a spindle 202, a roller 204, and a shaft collar 206. The spindle 202 is rigidly mounted in cantilever manner into the upper right side surface of the input upright 181 of the paper feed lateral adjustment frame 20 and rotatably receives the roller 204. The shaft collar 206 is fixedly attached at the free end of the spindle 202 to retain the roller 204 in proper place. The first paper guide 199 is identical in construction and disposition to the second paper guide 200. The first paper guide 199 is mounted at the input end of a standoff roller mount 208 that is in turn rigidly affixed in cantilever manner to the upper input surface of the middle upright 179.

The top longitudinal bar 195 extends toward the output end of the machine in cantilever disposition, being rigidly affixed in its left hand input end to the upper right hand surface of the middle upright 179 by means of an intervening spacer, not shown. This permits the movable pivot assembly 197 to translate in the input direction. It is restrained from leaving the output end of the top longitudinal bar 195 by means of a transverse bar 210. With the movable pivot assembly 197 placed at the input end of the top longitudinal bar 195, a roll of the banding paper 212 is placed and retained upon a roller and spindle of the movable pivot assembly 197. This is necessary due to the space occupied by the stack forming machine (not shown) that provides input to the bundle banding machine 10. The movable pivot assembly 197 and the roll of banding paper 212 are moved to the output end of the top longitudinal bar 195, so that the roll of paper does not interfere with the human operators of the machine.

The movable pivot assembly 197 locates the roll of banding paper 212 on the centerline of the paper feed lateral adjustment frame 20 and consequently on the centerline of the lateral adjustment frame 14. In this position clockwise rotation of the roll of banding paper 212 feeds the strip of banding paper 38 off the roll downwardly over the first paper guide 199 clockwise around the second paper guide 200 and into the sloping paper guide 44. The sloping paper guide 44 is comprised of an elongated pan 214, a pair of side bars 216 and an attachment assembly 218. The elongated pan 214 is provided with a pair of transverse flat plates 220 rigidly affixed to the underside of and approximate the ends of the elongated pan 214. Each of the pair of transverse flat plates 220 is provided with a set of holes 222, some of which also pass through the elongated pan 214 as can be seen in FIG. 7. These holes cooperate with tapped holes in the pair of side bars 216 to form adjustable guides for the elongated pan 214 to cooperate with three specific widths of banding paper 38. The side bars 216 therefore can closely guide a specific width of banding paper 38 along the centerline of the paper feed lateral adjustment frame 20 and into the lower portion of the base frame 12 as is shown in FIG. 5.

Stack Handling Stations

Figure 8:
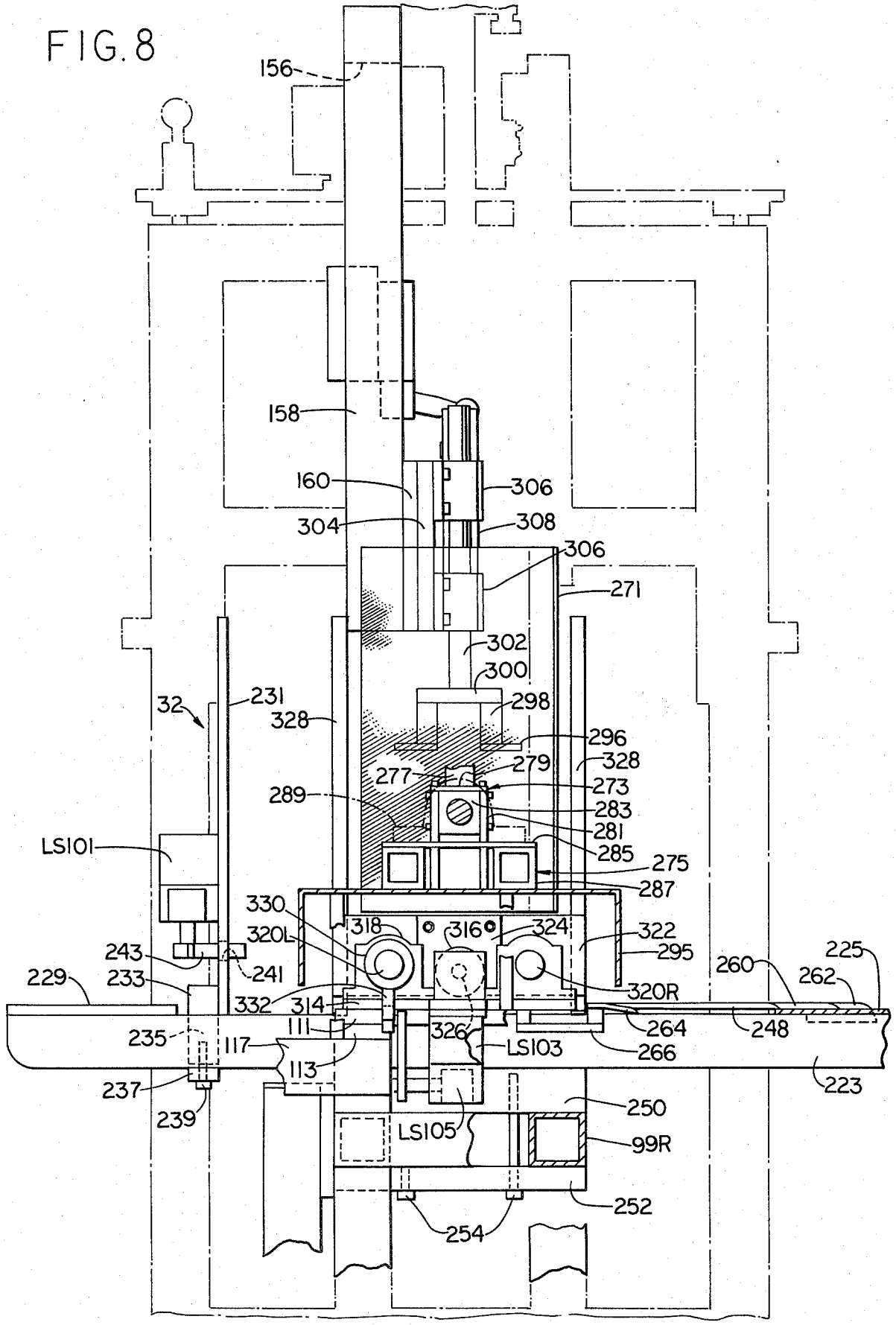
FIG. 8 is a view in upright section taken generally along the line 8—8 in FIG. 5, mechanical parts being cut away for clarity.

The input station 22 is shown in FIGS. 1, 6, 8 and 9. Output members of a stack forming machine 221 (only a portion of which is shown) cooperate with members of the input station 22 of the bundle banding machine 10 to transfer the stack of cartons 58 to the input station 22. The output members of the stack forming machine are comprised of a pair of transverse bars 223, an output table 225 consisting of sections 225A and 225B, and the stop assembly 32. The pair of transverse bars 223 is an integral part of the structure of the stack forming machine and extends laterally through the bundle banding machine 10 to protrude from the left hand side thereof. The free ends of the pair of transverse bars 223 are held in rigid relationship with each other by an end plate 229 that is rigidly affixed at the top left hand end portions thereof. The output table 225 of the stack forming machine is fixedly attached across the pair of transverse bars 223 on the right side of the bundle banding machine 10, a portion of which is shown in FIGS. 6 and 8.

The stop assembly 32 is adjustably mounted upon the pair of transverse bars 223 adjacent the left side of the bundle banding machine 10. It is comprised of a stop plate 231, an upper mounting bar 233, a center member 235, a clamp bar 237, and a fastener 239. The upper mounting bar 233 and the center member 235 are rigidly affixed to each other to form a "T" member, the center member 235 being disposed downwardly between the pair of transverse bars 223 to clampedly cooperate with the clamp bar 237. The fastener 239 passes through a clear hole in the clamp bar 237 to threadably mount into the bottom end of the center member 235, thereby forming an adjustable mount by virtue of the single fastener 239. The stop plate 231 is rigidly affixed along its lower left hand side to the right hand face of the upper mounting bar 233, thereby disposing it vertically upward. The stop plate 231 is provided with a slot 241 through which a trip arm 243 extends. The trip arm 243 is the sensing member of a limit switch LS101 that is in turn fixedly attached to the left surface of the stop plate 231.

Input members of the bundle banding machine 10 include the input table assembly 28, the input guide assembly 30, the primary compressor 34 and the pusher assembly 36. The input table assemby 28 is comprised of an input table 246 and a pickup table 248. The input table 246 is a piece of sheet stock rectangular in form that is fixedly held in horizontal plane by a standoff plate mount 250 that spans the width of the input table 246 and places it at proper height above the pair of horizontal members 99L and 99R of the auxiliary frame 93 of the lateral adjustment frame 14. The standoff plate mount 250 is clampedly attached about the horizontal members 99L and 99R by means of a bar 252. The bar 252 is provided with a pair of clear holes through which a pair of clamp bolts 254 pass vertically upward to threadably mount into the bottom portion of the standoff plate mount 250. A pair of posts 256 is fixedly attached to the underside of, and adjacent to the output edge of the input table 246, in such place so that the bottom extremities of the pair of posts 256 rest upon the upper output surfaces of the pair of horizontal members 99L and 99R. This stabilizes the horizontal disposition of the input table 246 without interfering with its convenient adjustment by means of the pair of clamp bolts 254.

The pickup table 248 represents a transitional subassembly that transfers the stack of cartons 58 from the output table 225 of the stack forming machine to the input table 246 of the bundle banding machine 10. With respect to the pickup table 248 only, the directional convention of input and output and left and right will be transverse of the bundle banding machine 10 to coincide with the direction of the stack flow at this point. The pickup table 248 is then comprised of a pair of plates 258L and 258R, each member of the pair being an identical mirror image of the other. The right hand member 258R is provided with an alignment lip 262, a central pickup lip 260, and an outer pickup lip 264. The alignment lip 262 is rigidly affixed to the inboard input edge of the plate 258R. The alignment lip 262 hangs downwardly from the plate 258R as well as protruding from the leading edge thereof. The upper input corner of the alignment lip is provided with a radius. The center pickup lip 260 is formed by rounding off the edge of the material, so that the circumference of the leading edge radius is tangent to the top surface and the radius itself is considerably larger than the thickness of the material. The central pickup lip 260 also sweeps outwardly and in the output direction. The outer pickup lip 264 is placed transversely to the stack flow being provided with the same leading edge radius as described above for the central pickup lip 260. The outer pickup lip 264 itself is broken downwardly from a line parallel and adjacent the trailing edge of the part. The input end of the pickup table 248 rests upon the top surface of the output table 225 of the stack forming machine. The output end of the pickup table 248 is supported in vertical place by a pair of bridge brackets 266. Each of the pair of bridge brackets 266 is assembled in the shape of a "U", to provide clearance for the passage of the pusher assembly 36 and is fixedly attached to the undersides of the input table 246 and the pickup table 248 to place the trailing edge of the pickup table 248 slightly higher than the leading edge of the input table 246. All the above features of the pickup and input tables 248 and 246 respectively aid in picking up a stack of cartons 58 off the output table 225 of the stack forming machine. More specifically, the radiused corner of the alignment lip 262 lifts the central portion of the stack of cartons 58, the swept central pickup lip 260 continues to widen the pickup of the central portion of the stack, while the outer pickup lip 264 catches the outer edges thereof and ramps them up onto the pickup table 248. The trailing edge of the pickup table there permits the stack to pass over the edge of the input table 246.

The output pusher (not shown) of the stack forming machine pushes the stack of cartons 58 transversely from right to left into the bundle banding machine 10 by passing through a slot 268 formed by the parallel spaced relationship of the pair of transverse bars 223. The stack of cartons is moved to the left, with respect to the bundle banding machine 10, so that the right face of the stack of cartons 58 stops at the same lateral place without regard to carton size. The lateral adjustment frame 14 is then moved upon the base frame 12 until the stack of cartons 58 is properly centered. It should be noted that the pickup table 248 is free to slide upon the top surface of the output table 225 of the stack forming machine. When the stack 58 is at this position, the trip arm 243 of the limit switch LS101 is engaged.

The input guide assembly 30 of the input station 22 of the bundle banding machine 10, provides lateral and non-rotational translation for the stack of cartons 58 as it is being moved by the pusher assembly 36 of the bundle forming machine. The input guide assembly 30 is shown in FIGS. 5, 6 and 8. It is comprised of a transparent plastic guide plate 271, a slide mount 273, and a fixed mount 275. The guide plate 271 is provided with an angled leading edge face, that is, a right hand edge portion 276 of the plate 271 is angled away from the transverse line of movement of the incoming stack of cartons 58 as is shown in FIG. 6. This angled edge portion catches the stack of cartons and places same in sliding contact with the face of the guide plate 271.

The guide plate 271 is fixedly attached to the slide mount 273 by means of a vertical bar 277. The slide mount 273 is comprised of a bridge plate 279, a pair of slide plates 281, and a thread block 283. The slide plates 281, being vertically disposed, are fixedly attached to the sides of the thread block 283 so that the threaded bore thereof is horizontal. The vertical bar 277 is rigidly affixed at its bottom extremity to the upper output surface of the bridge plate 279, that is in turn fixedly attached to the top surface of the thread block 283 so that it overhangs in the output direction.

The fixed mount 275 is comprised of a mount plate 285 that is rigidly affixed upon the top surface of a pair of standoff tubes 287. Fixedly attached in spaced relationship upon the top surface of the mount plate 285 is a pair of pillow block bearings 289. The pair of pillow block bearings 289 cooperate to rotatably hold a shaft 291 in longitudinal disposition. The shaft 291 is fixedly attached within the inner race of each bearing and is fixedly provided with a handle 293 at its input extremity. The output length of the shaft 291 is threaded and cooperates with the threaded bore of the thread block 283 of the slide mount 273. The lower portions of the pair of slide plates 281 extend longitudinally in the input direction to slidably fit at close tolerance under the mount plate 285 providing vertical stability to the guide plate 271. By turning the handle 293, the operator can set the guide plate 271 and the desired longitudinal location to fully cooperate in frictionally guiding the stack of cartons 58 into the bundle banding machine 10.

The input guide assembly 30 is rigidly mounted upon the top surface of a pusher cover 295 by rigidly affixing the pair of standoff tubes 287 toward the output end thereof. The pusher cover 295 is in turn fixedly attached above the pusher assembly 36 as will be described hereinafter.

The primary compressor 34 is shown in FIGS. 5 and 8. It is comprised of a pair of pressure plates 296, a pair of standoff plates 298, a rod mount plate 300, and a pair of bearing rods 302. The pressure plates 296 are fixedly attached to the bottom edge of the vertically disposed standoff plates 298. The pair of pressure plates 296 overhang the pair of standoff plates 298 in the output direction to provide hold-down pressure while the stack of cartons 58 is being moved out of the input station 22. The top edges of the standoff plates 298 are fixedly attached to the bottom face of the rod mount plate 300, being laterally spaced in parallel relationship at the edges thereof. The bearing rods 302 are fixedly attached into the top surface of the rod mount plate 300 and longitudinally spaced in parallel relationship adjacent each end thereof.

The primary compressor 34 is further comprised of a bearing mount plate 304, a set of four linear ball bearings 306, and a compressor cylinder 308. The set of four linear ball bearings 306 is fixedly attached at the corners of and upon the right hand surface of the bearing mount plate 304 that is in turn fixedly attached to the right hand surface of the compressor mount plate 160. The head portion of the compressor cylinder 308 is fixedly attached to the right hand lower central surface of the bearing mount plate 304, so that a piston rod 310 of the cylinder 308 extends downwardly to be fixedly attached into the center of the top surface of the rod mount plate 300. The pair of bearing rods 302 cooperate with the ball bearings 306. A downward compression force is provided upon the top of the stack of cartons 58 by action of the compressor cylinder 308. A limit switch LS102 is fixedly mountd upon the output surface of vertical post 158 so as to cooperate with a trip arm 312 that is fixedly provided upon the upper portion of the output member of the pair of bearing rods 302. This limit switch provides an electrial signal to indicate that the primary compressor 34 is down and activates the pusher assembly 36 and the extraction assembly 54 as will be described hereinafter.

The pusher assembly 36 is shown in FIGS. 5 and 8. It is comprised of a bearing plate 314, whose plan view is in the shape of an exaggerated "T", the cross bar portion of which is fixedly attached to the top surface of the square plate 111 of the pusher standoff table 109. The stem of the "T" extends longitudinally in the input direction and constitutes a mounting surface for a compressor cylinder 316. The compressor cylinder 316 is fixedly attached at both ends to the upper surface of the bearing plate 314. The cross bar portion of the bearing plate 314 also provides mounting space for a set of four guide bearings 318 that is fixedly attached thereto. A pair of guide rods 320L and 320R is fixedly attached into the input surface of a pusher plate 322. The central portion of the pusher plate 322 fixedly accommodates a rod end plate 324. A cylinder rod 326 of the pusher cylinder 316 is threadably mounted into the input side of the rod end plate 324. With the pair of guide rods 320L and 320R cooperating with the set of four guide bearings 318, the pusher cylinder 316 is able to move the pusher plate 322 back and forth in longitudinal translation. A pair of pusher bars 328 is vertically disposed along the vertical edges of, and fixedly attached to the output surface of the pusher plate 322 so that the pusher bars 328 extend slightly below and mostly above the pusher plate 322. This arrangement provides a spaced parallel line contact with the input side of the stack of cartons 58, thereby moving the stack without rotation and side guides. The input end of guide rod 320L is provided with a trip collar 330. Rigidly affixed to and extending downwardly therefrom is a trip tab 332 that cooperates with trip levers of limit switches LS105 and LS103. The limit switches are fixedly attached to the underside of the bearing plate 314 and are located longitudinally at assembly to provide the proper sequential timing of events in the operating cycle of the bundle banding machine 10. The limit switch LS105 is momentarily made by the trip tab 332 as the pusher assembly moves in the output direction. In doing so, a circuit is made that starts the deposit of glue on the banding paper 38. As the pusher stops at full extension the limit switch LS103 is made and held thus giving a continuous signal that the pusher is in the extended position. The limit switch LS103 also makes circuits to activate the secondary compressor assembly 48 and release pressure on the primary compressor 34 and the upper paper handling assembly 52. In time delay sequence the pusher assembly 36 returns to its full back position and lowers a portion of the upper paper handling assembly 52 to spread the glue and dispose and end of the banding paper 38 downwardly as will be more fully described hereinafter. The pusher assembly 36 is indicated in FIG. 5 in full back position.

Compressor Assemblies

Figures 9, 9A:
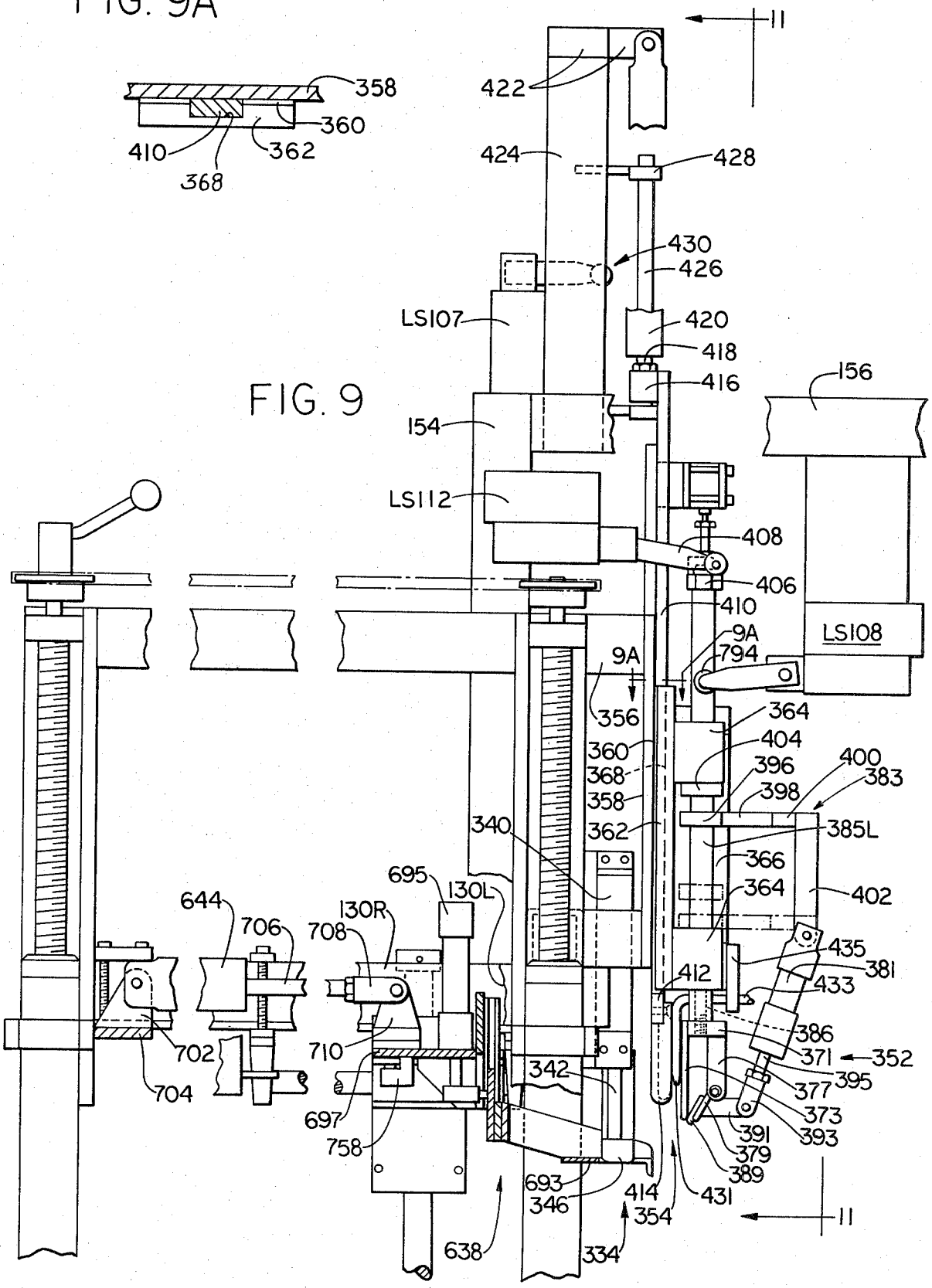
FIG. 9 is an enlarged fragmentary view in side elevation enlarging upon the upper left hand quadrant of FIG. 1, some portions being center line sectioned for clarity.
FIG. 9A is a view in section taken on the line 9A—9A in FIG. 9.

The secondary compressor assembly 48 is shown in FIGS. 2, 4, 9 and 10, and is comprised of a lower assembly 333 (FIGS. 2 and 10) and an upper assembly 334 (FIGS. 4 and 9). The lower assembly 333 of the secondary compressor assembly 48 is comprised of vertical plate 335, a stabilizer plate 337, a cylinder 339, a clamp plate 341, a lower head or banding presser member 343 and a guide 345. The vertical plate 335 is clampedly attached upon the input surface of and at the centerline of the middle lateral brace 107 of the lateral adjustment frame 14 by means of the clamp plate 341, and a set of four long bolts 347. The set of four long bolts 347 pass through clear holes through the corners of the clamp plate 341 to reach around the middle lateral brace 107 and threadably mount into the upper end of the vertical plate 335, so that the vertical plate 335 hangs downwardly therefrom. The stabilizer plate 337 is rigidly affixed along the output edge of its left face to the right hand edge of the vertical plate 335 so that a right angle is formed. The cylinder 339 is fixedly attached to the protruding left hand face of the stabilizer plate 337, so that a rod 349 thereof extends upwardly. The free extremity of the rod 349 threadably accommodates the head member 343 that is slightly asymmetrical overhanging to the right side thereof. The guide 345 is rigidly affixed at the right side of and to the lower surface of the head member 343, thereby being disposed downwardly to cooperate in parallel alignment with the right side face of the stabilizer plate 337. This arrangement prevents rotation of the head member 343 that would otherwise cause interference with adjacent machinery.

The upper assembly 334 of the secondary compressor assembly 48 is of generally the same construction as the lower assembly 333. The upper assembly 334 is supported upon the center of the input lateral tube 134 of the vertical adjustment frame 16. A cylinder 340 of the upper assembly 334 actuates a rod 342 which carries an upper head or banding presser member 346. The cylinder 340 of the upper assembly and the rod 342 thereof are slightly longer than like elements of the lower assembly 333 to be able to cooperate with the defined space between the top of the stack of cartons 58 and the input lateral tube 134. The two cylinders 339 and 340 work in opposition to each other to compress the stack of cartons 58A.

Figure 11:
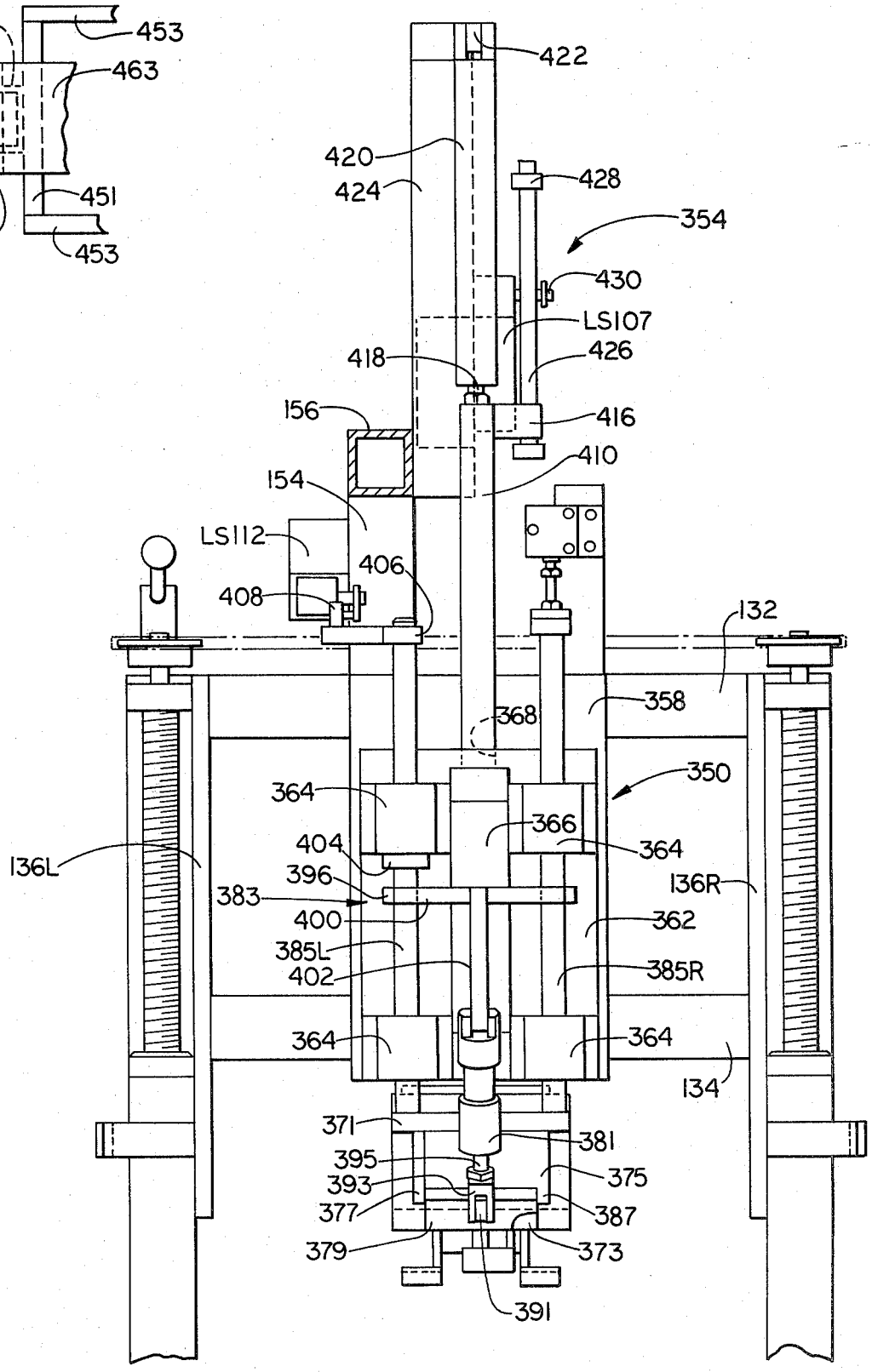
FIG. 11 is a fragmentary view in section taken on the line 11—11 in FIG. 9.

The upper paper handling assembly 52 of the bundle banding machine 10 is shown in FIGS. 4, 9 and 11. It is comprised of a mounting assembly 350, aclamp assembly 352, and an upper hand assembly 354. The mounting assembly 350 is further comprised of a set of four standoff tubes 356, a standoff plate 358, a pair of spacers 360, a guide plate 362, a set of four linear bearing blocks 364, and a cylinder 366. The input extremities of the set of four standoff tubes 356 are rigidly affixed to the output surface of, and at the corners of the standoff plate 358. The output extremities of the set of four standoff tubes 356 are rigidly affixed to and centered upon the input surfaces of the upper input lateral tube 132 and the input lateral tube 134, both of the vertical adjustment frame 14. The set of four linear bearing blocks 364 is fixedly attached in a spaced rectangular pattern upon the input face of the guide plate 362 that is in turn fixedly attached to the input face of the standoff plate 358 by the intervening auspices of the pair of spacers 360. The cylinder 366 is fixedly attached in the inverted vertical disposition upon the input face of the guide plate 362 and between the set of four linear bearing blocks 364 as is shown in FIG. 11. It is to be noted that a groove 368 is incorporated in the output face of and disposed along the vertical centerline of the guide plate 362 to cooperate with the upper hand assembly 354 that will be discussed herein.

The clamp assembly 352 (FIGS. 9 and 11) is comprised of a rod mount plate 371, a clamp 379, a clamp cylinder 381, and a cylinder bracket 383, and a pair of bearing rods 385L and 385R. The pair of bearing rods 385L and 385R is fixedly attached within the top surface of the horizontally disposed rod mount plate 371, and located in lateral and parallel spaced relationship near the ends thereof. The pair of bearing rods 385L and 385R extend upwardly to cooperate with the set of four linear bearing blocks 364 of the mounting assembly 350. A cylinder rod 386 of the cylinder 366 extends downwardly therefrom to threadably and fixedly attach into the central upper surface of the rod mount plate 371. Aback plate 373 is attached to the output side of the rod mount plate 371 and extends downwardly therefrom.

Fixedly attached to the bottom surface of and along the input edge of the rod mount plate 371 is a pivot mount 375. The pivot mount 375 is an asymmetrical piece that is provided with a pivot lobe 387 at its lower right hand corner. A clamp 379, being provided with pivot pins in its upper sides, is inserted within a pivot bore of the pivot lobe 387 and pivotally retained therein by the same means provided in a pivot cap 377 that is in turn fixedly attached along the left hand end of the pivot mount 375. The clamp 379 is provided with a rubber pad 389, chemically bonded to the output surface thereof, and a pivot lever 391 that is rigidly affixed to the input surface of the clamp 379. The free extremity of the pivot lever 391 is provided with a clear bore to cooperatewith a pin and clevis 393 that is in turn threadably and fixedly attached to the working end of a cylinder rod 395 of the clamp cylinder 381. The clamp cylinder 381 is pivotally attached to the lower extremity of the cylinder bracket 383. The cylinder bracket 383 is comprised of a pair of shaft collars 396, a pair of standoff bars 398, a lateral brace 400, and a vertical bar 402. The vertical bar 402 is provided with a clear bore laterally through its lower extremity to cooperate with the mounting of the clamp cylinder 381. Its upper output surface is rigidly affixed across the input face, and center disposed upon the lateral brace 400 that is in turn rigidly affixed at its output surface to the input extremity of the pair of standoff bars 398. The standoff bars 398 are fixedly attached to the input sides of the shaft collars 396. The shaft collars 396 are in turn fixedly attached upon the pair of bearing rods 385L and 385R in such location as not to interfere with the upward movement thereof but to limit the downward movement of the clamp assembly 352. The upward movement of the clamp assembly 352 is limited by a stop collar 404 that is fixedly attached upon the left hand bearing rod 385L placed just above the cylinder bracket 383. The upper end of the left hand bearing rod 385L is fixedly fitted with a collar and trip arm 406, the arm portion thereof extending laterally to the left to cooperate with an actuator arm 408 of a limitswitch LS112. The limit switch LS112 is in turn fixedly attached to the left hand surface of, and adjacent the upper end of the vertical riser 154.

The upper hand assembly 354 is comprised of a slide bar 410, a cross bar 412, and an upper hand 414. The upper hand 414 is fixedly attached to the cross bar 412 and is formed to fit the cross bar 412 along its lower surface and partially upward along its input surface. The cross bar 412 is in turn rigidly affixed to the lower extremity of the slide bar 410 to form an inverted "T" structure. The slide bar passes vertically upward through the groove 368 of the guide plate 362 being slidably held therein by the spacing and surface restraint of the pair of spacers 360 on the standoff plate 358. The upper output end of the slide bar 410 is rigidly provided with a rod block 416. The rod block 416 threadably and fixedly retains the working end of a cylinder rod 418 of an upper hand cylinder 420. The upper end of the upper hand cylinder 420 is pivotally mounted to a top pivot mount 422 that is of irregular shape to both hold the cylinder in proper place and be rigidly affixed to the top extremity of an upright mount 424. The lower left hand surface of the upright mount is rigidly affixed to the right hand surface of, and adjacent the output end of the horizontal member 156 of the vertical adjustment frame 16. The rod block 416 extends laterally to the right to clampedly retain a vertical rod 426 that in turn clampedly retains a trip collar 428 adjacent the top end thereof. The trip collar 428 cooperates with the actuator arm 430 of the limit switch LS107, the limit switch LS107 being fixedly attached to the lower output surface of the upright mount 424.

Referring now to FIG. 9, a glue nozzle 431 is formed at the end of a glue tube 433. The glue tube 433 is clampedly retained through the lower portion of a tube mount 435 that is in turn fixedly attached to the input side of a lower mounting block associated with the cylinder 366 of the mounting assembly 350. The glue tube 433 incorporates a right angle turn so that the glue nozzle 431 can be disposed downwardly between the upper hand assembly 354 and the clamp assembly 352 and adjacent the bottom edges thereof while both assemblies are in their up position. The glue tube 433 communicates with a remotely placed glue reservoir, pump and control valve not shown in detail in the Figures.

Paper Handling Assemblies

Figure 2:
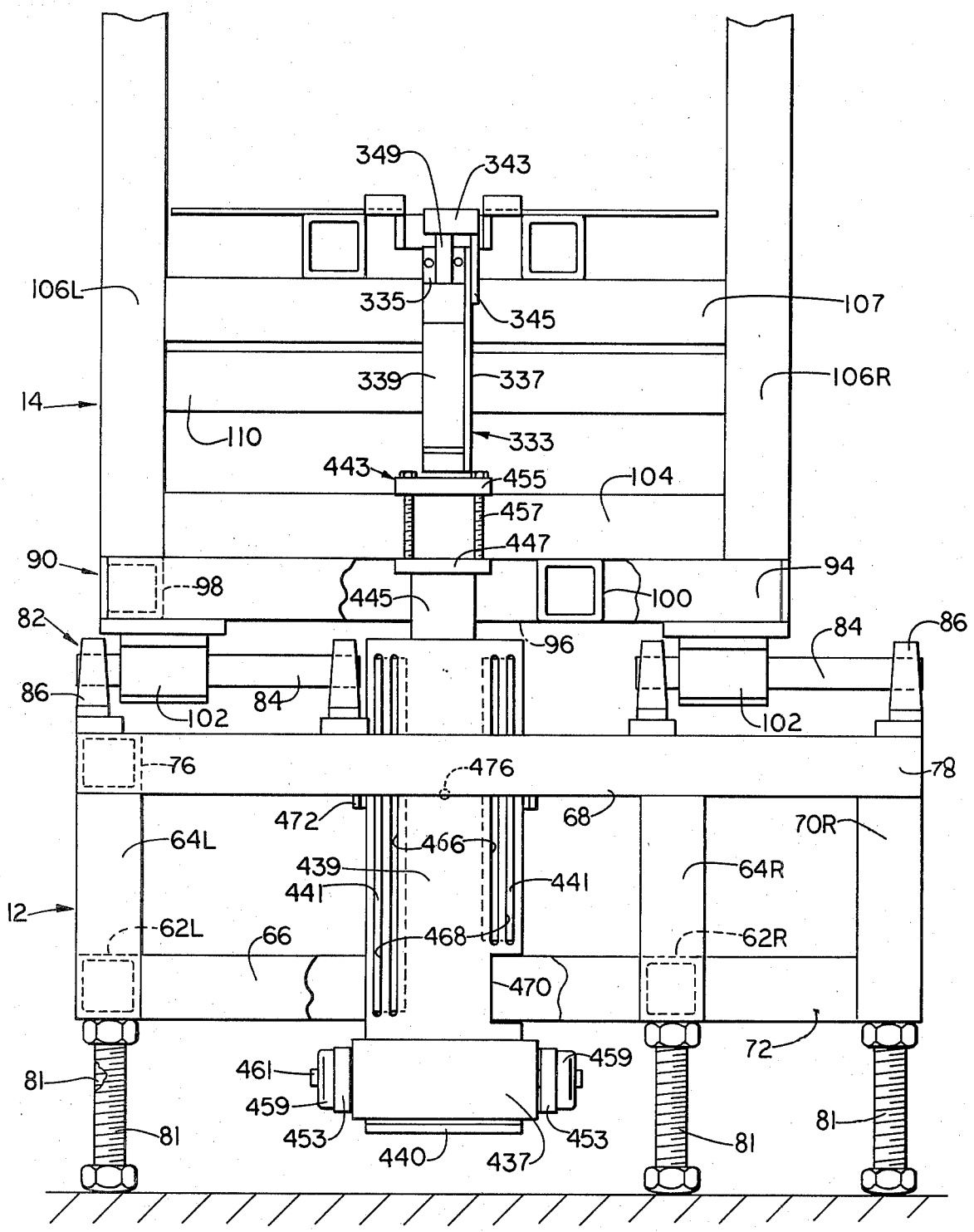
FIG. 2 is a view in upright section taken generally along the line 2—2 in FIG. 1, certain structures being omitted for clarity.
Figure 10:
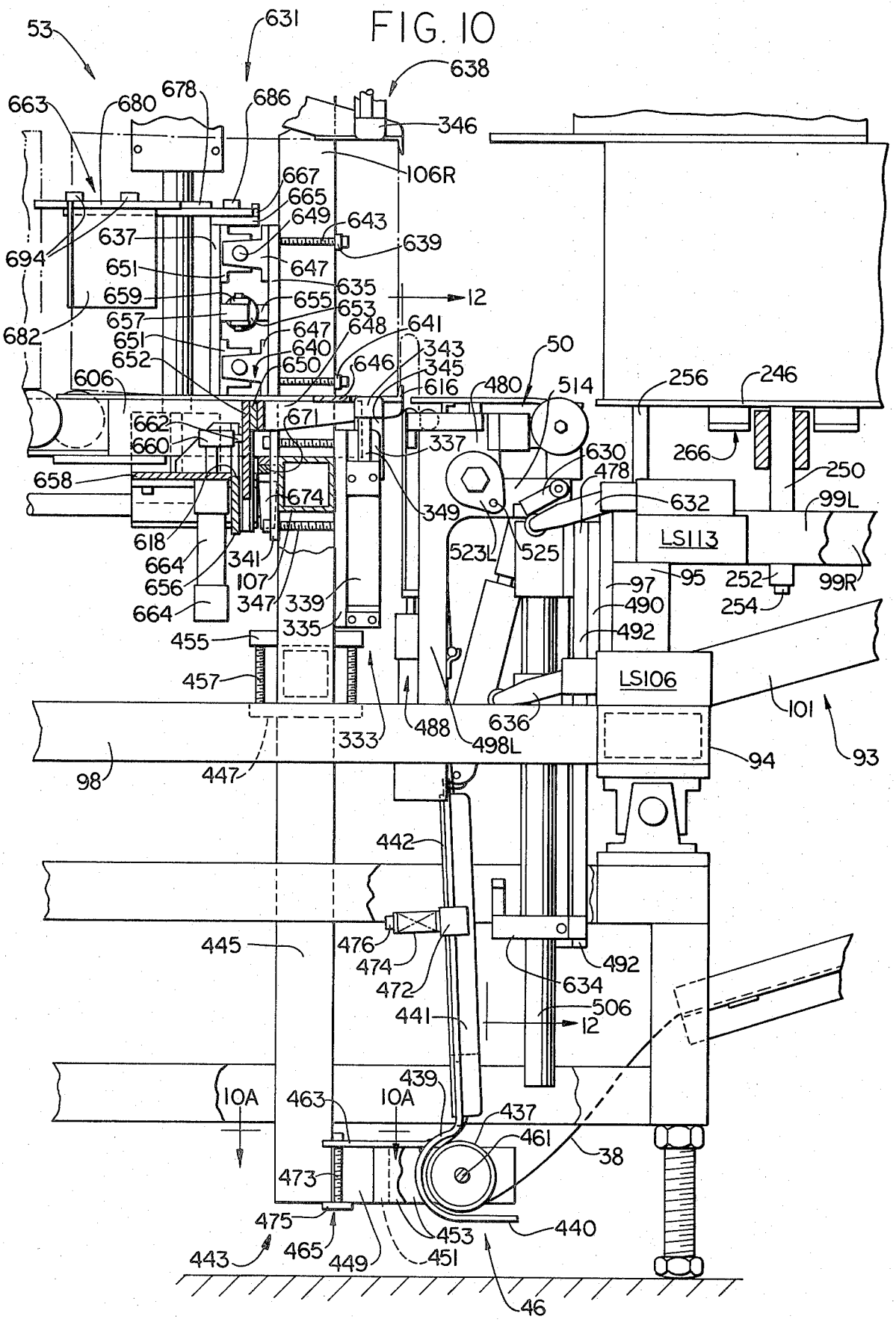
FIG. 10 is an enlarged fragmentary view in side elevation enlarging upon the lower central portion of FIG. 1, some assemblies being center line sectioned or cut away for clarity.
Figure 10A:
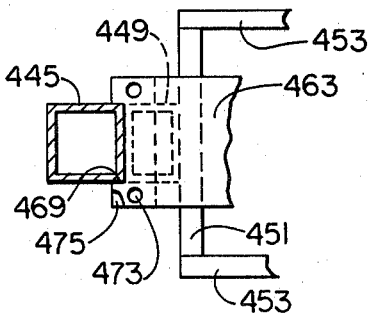
FIG. 10A is a view in section taken on an enlarged scale on the line 10A—10A in FIG. 10.

The vertical paper guide 46 guides the banding paper 38 upwardly into the lower paper handling assembly 50. The vertical paper guide 46 is shown in FIGS. 2 and 10 and is comprised of an intake roller 437, a body guide 439, a pair of side angles 441, and a suspended mount frame 443. The suspended mount frame 443 is further comprised of a vertical post 445, a clamp mount 447, a tube spacer 449, a transverse plate 451, and a pair of end plates 453. The top extremity of the vertical post 445 is rigidly affixed to the bottom surface of the clamp mount 447, that is in turn clampedly affixed to the bottom surface of, and at the center of the base lateral member 104 of the lateral adjustment frame 14 by means of a clamp plate 455 and a set of four bolts 457. The tube spacer 449 is rigidly affixed between the lower input surface of the vertical post 445 and the center output surface of the transverse plate 451. The end plates 453 are rigidly affixed to end portions of the transverse plate 451 and extend in the input direction therefrom in cantilever disposition. A clear through hole is provided in the pair of end plates 453 to cooperate with a pair of bearings 459 that in turn rotatably hold a shaft 461 upon which the intake roller 437 is fixedly attached. The body guide 439 is provided with a mount plate 463 that is rigidly affixed in horizontal disposition to the output side of the body guide 439. The mount plate 463 is provided with a notch 469 (FIG. 10A) in its output edge to accommodate the vertical post 445 to provide some bearing against non-axial horizontal displacement and space for a clamp mount 465. The clamp mount 465 includes fasteners 473 which extend through clear holes (not shown) in the mount plate 463 and are threaded in a clamp plate 475.

As shown in FIG. 10, the body guide 439 circumscribes the output side of the intake roller 437, the bottom extremity being finished in a horizontal lip 440. The upper portion of the body guide 439 extends nearly upward to cooperate with the lower paper handling assembly 50. Referring now to FIG. 2, the body guide 439 is provided with a pair of inner slots 466, a pair of outer slots 468, and a notch-out 470. The side guide angles 441 are shown in FIG. 2 cooperating with the pair of outer slots 468 so that the longitudinally disposed flanges thereof pass in the input direction through the pair of outer slots 468 to provide lateral guidance for the medium size banding paper 38. Transversely disposed flanges 442 of the side guide angles 441 are clampedly held against the output surfaces of the body guide 439 by a bracket clamp 472. Flanges 442 of the side guide angles 441 can face inboardly to facilitate their being clampedly held through the pair of inner slots 466 to provide guidance for a narrow width banding paper 38, or to facilitate their being clampedly held around the vertical edges of the body guide 439 itself to provide guidance for a wide banding paper 38. The bracket clamp 472 is urged against the side guide angles 441 by a spring 474 that is compressively mounted under the head of a bolt 476 that is in turn threadably mounted into the output face of the body guide 439. The notch 470 is provided in the right hand side of the body guide 439 to prevent interference with the right hand bottom stringer 62R of the base frame 12 when the lateral adjustment frame 14 is moved all the way to the right.

Banding paper 38 enters the base frame 12 from the sloping paper guide 44, passes under the intake roller 437, frictionally doubles back to enter the vertically disposed side guide angles 441, and passes upwardly into the lower paper handling assembly 50 along the center line of the lateral adjustment frame 14 regardless as to what paper width is used. The friction inherent in the upright paper guide 46 prevents slack from entering the lower paper handling assembly 50.

The lower paper handling assembly 50 is shown in FIGS. 10 and 12–17 inclusive. The lower paper handling assembly 50 is comprised of a stationary frame assembly 478, a movable frame assembly 480, a ratchet feed assembly 482, a wireform paper guide 484, a cutter assembly 486, and a lower hand assembly 488.

Figure 13:
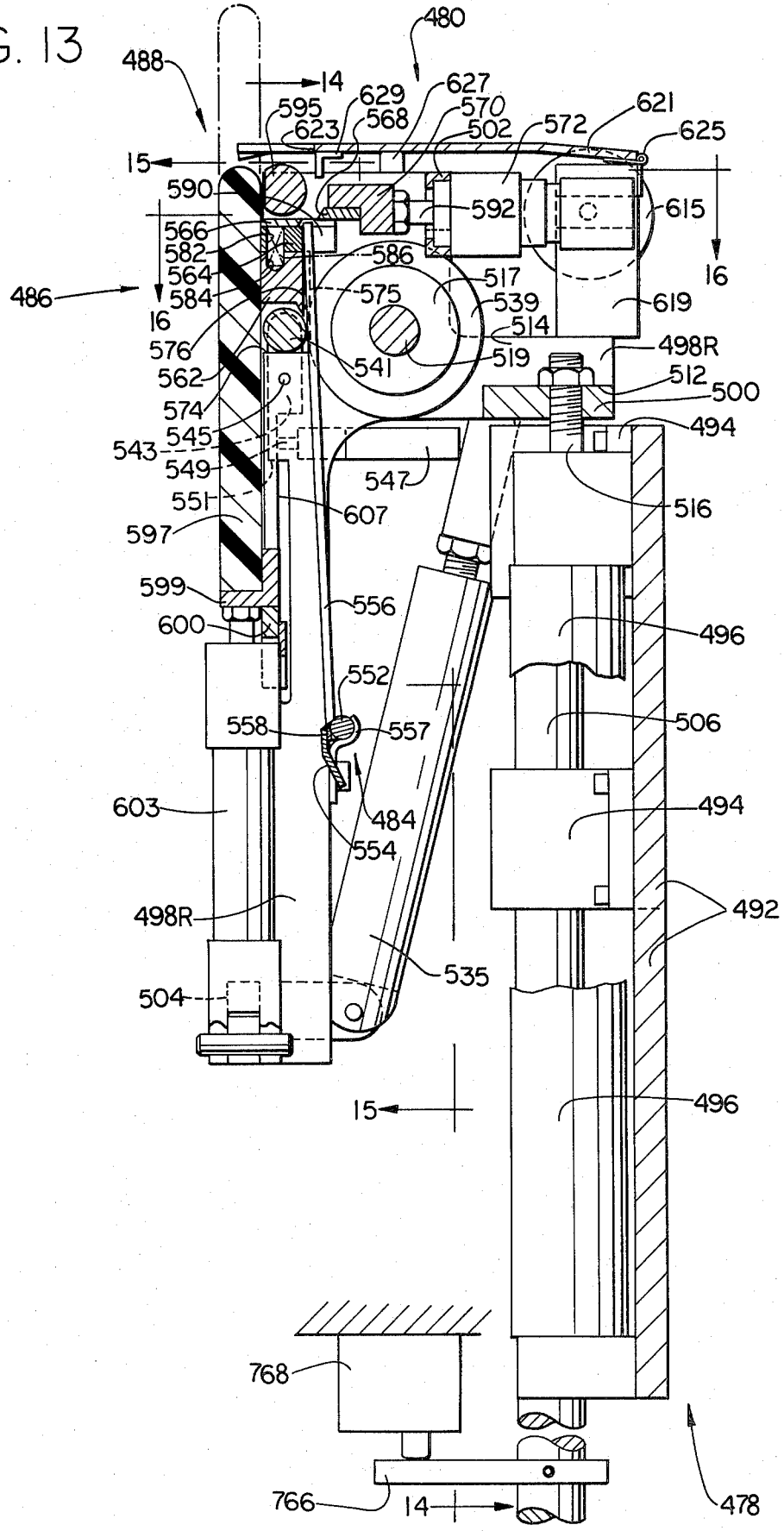
FIG. 13 is a view in upright section taken along the line 13—13 in FIG. 12.
Figure 14:
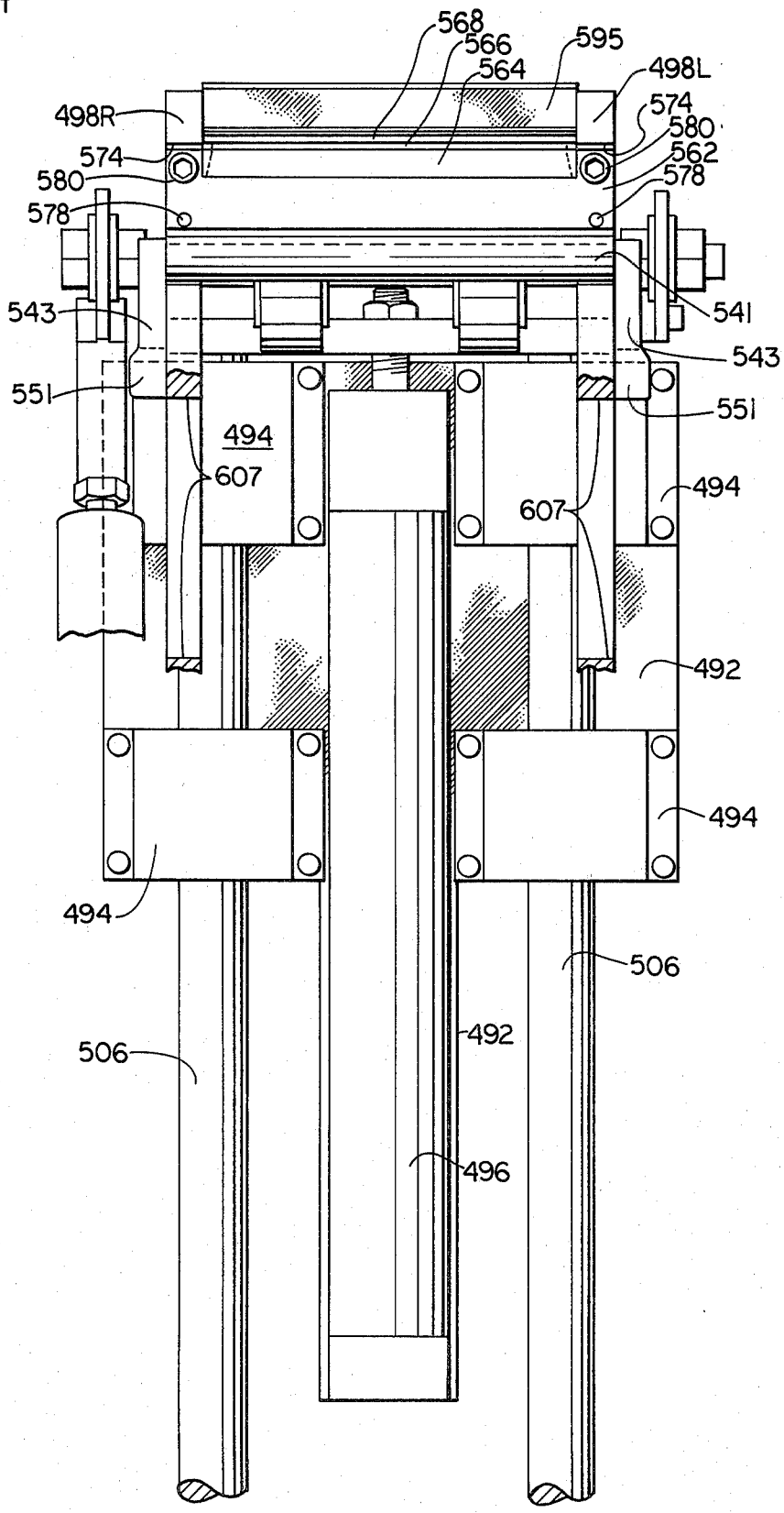
FIG. 14 is a view in upright section taken generally along the line 14—14 in FIG. 13.

The stationary frame assembly 478 is best shown in FIGS. 10, 13 and 14. It is comprised of a spacer plate 490, a pusher mount plate 492, a set of four guide bearings 494, and a lower feed cylinder 496. The pusher mount plate 492 is essentially a rectangular plate (FIG. 14) that is provided with a lower central extension for mounting of the lower feed cylinder 496. The feed cylinder 496 is fixedly attached in upright disposition to the pusher mount plate 492 through end blocks that are integral parts of the cylinder. The set of four guide bearings 494 is fixedly attached in a rectangular pattern to an output surface of the pusher mount plate 492. The pusher mount plate 492 is in turn fixedly attached through the intervening auspices of the spacer 490 to the output surface of the face plate 97 of the auxiliary frame 93 of the lateral adustment frame 14.

Figure 12:
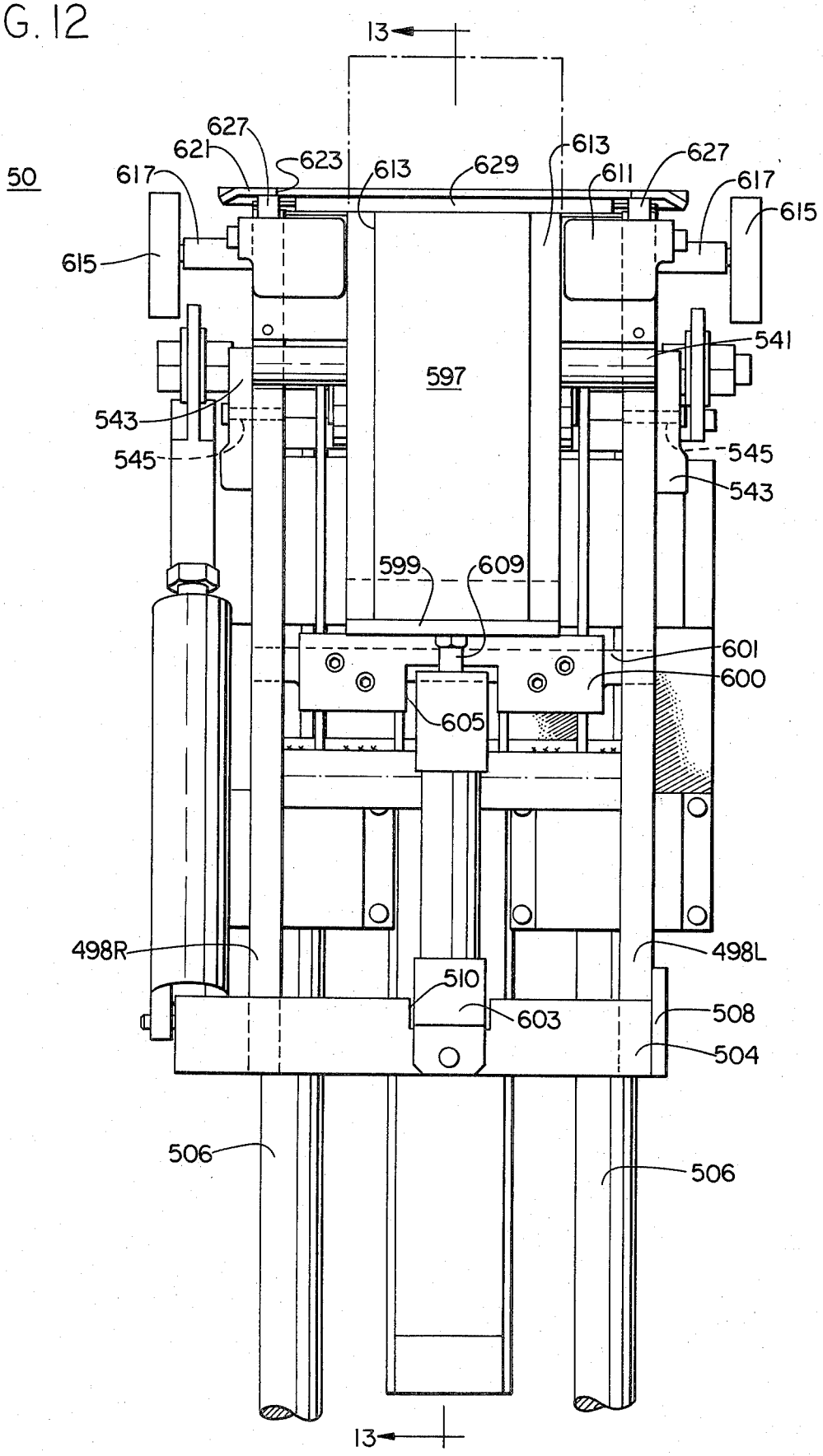
FIG. 12 is a view in front elevation of a lower paper handling assembly within the central portion of the bundle banding machine.

Referring now to FIGS. 12 and 13, the movable frame assembly 480 is comprised of a pair of side plates 498L and 498R, a rod mount plate 500, an upper cylinder bar 502, a lower cylinder bar 504, and a pair of guide rods 506. The pair of side plates 498L and 498R is of irregular shape and is fixedly held in spaced parallel relationship by the upper and lower cylinder bars 502 and 504, and the rod mount plate 500. The upper cylinder bar 502 is fixedly attached within a notch provided in the upper input corner of the pair of side plates 498L and 498R. The left hand extremity of the lower cylinder bar 504 is rigidly provided with an end tab 508 that lies flush against the left hand surface of the lower most portion of the left hand side plate 498L and is fixedly attached thereto. The right hand end of the lower cylinder bar 504 is fixedly attached to the output lower edge of the right hand side plate 498R and extends slightly to the right therefrom in cantilever form. The central portion of the lower cylinder bar 504 is also provided with a central notch 510 in the upper edge thereof. The rod mount plate 500 is fixedly attached within a mount notch 512 provided within the lower portion of an input extension 514 of the pair of side plates 498L and 498R. The pair of guide rods 506 is fixedly attached in spaced parallel relationship within the lower surface of the rod mount plate 500 to cooperate with the set of four guide bearings 494 of the stationary frame assembly 478. A cylinder rod 516 of the lower feed cylinder 496 is threadably and fixedly attached through the central portion of the rod mount plate 500 thereby motivating the movable frame assembly 480 in vertical displacement.

Figure 15:
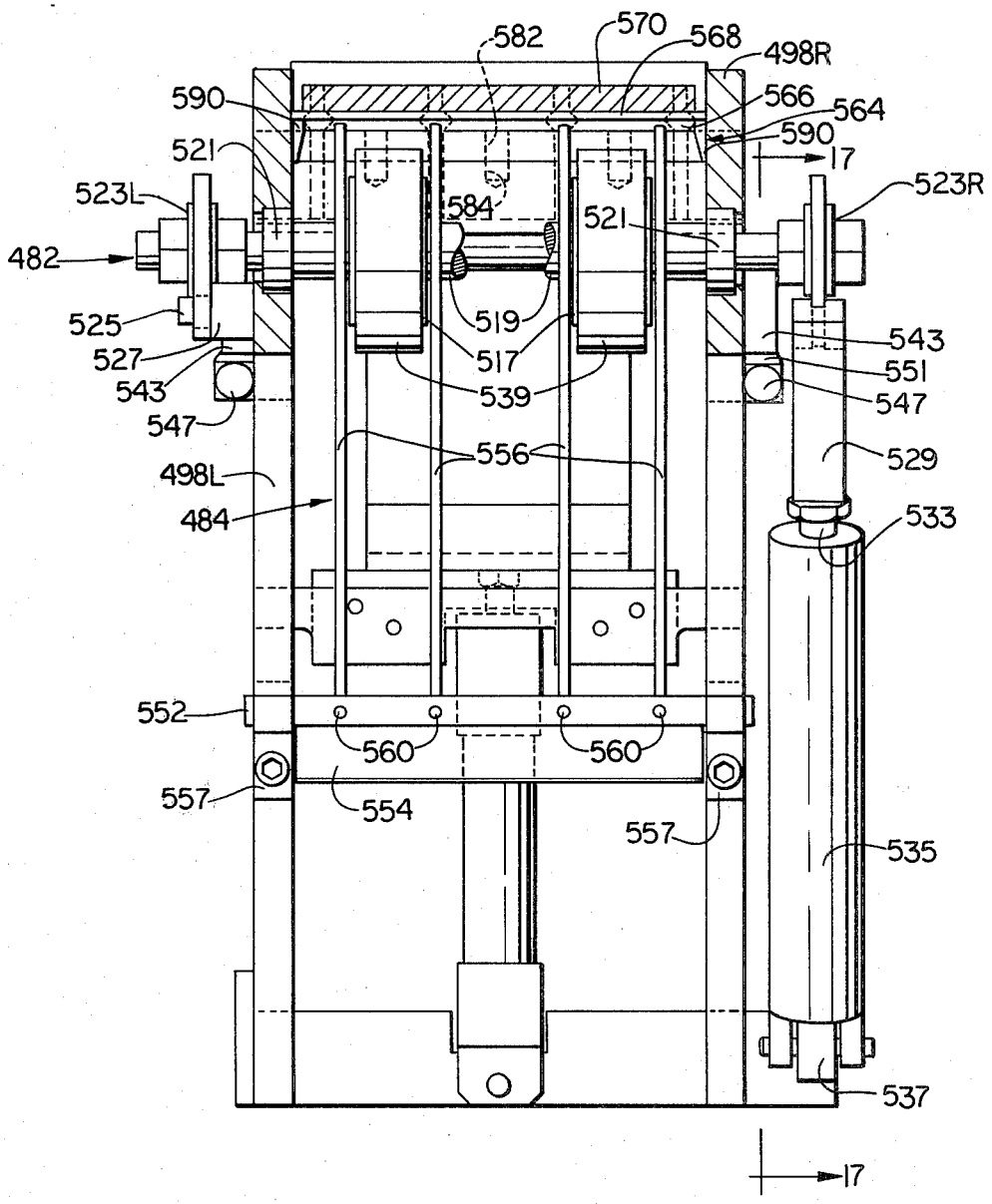
FIG. 15 is a view in upright section taken generally along the line 15—15 in FIG. 13.
Figure 17:
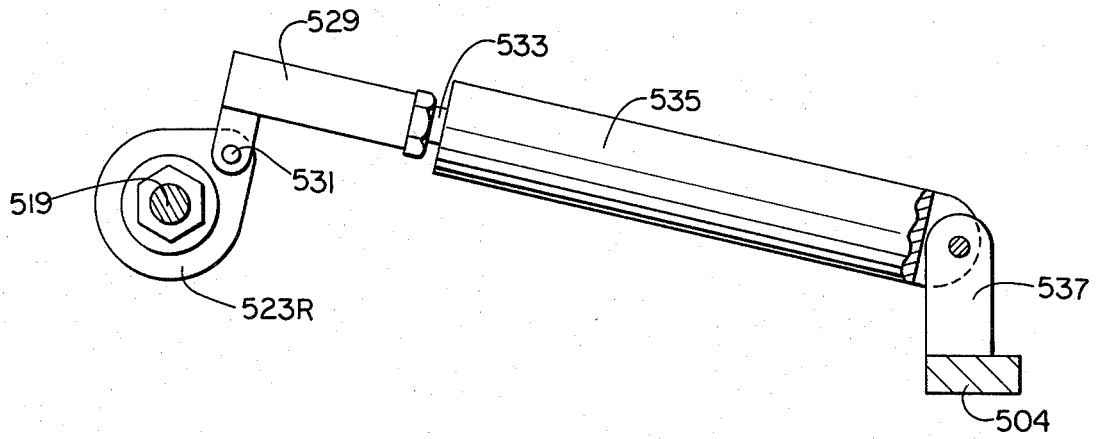
FIG. 17 is a sectional view taken along the line 17—17 in FIG. 15.

The ratchet feed assembly 482 is best shown in FIGS. 13, 15 and 17. It is provided with a pair of feed wheels 517. The feed wheels 517 are fixedly attached in spaced disposition upon the central portion of a feed shaft 519 that is in turn rotatably mounted in a pair of bearings 521. The bearings 521 are press mounted into the inboard surfaces of the side plates 498R and 498L. The outboard extremities of the feed shaft are provided with overrunning clutches 523L and 523R. As shown in FIGS. 10 and 15, an outer case of the left hand overrunning clutch 523L is prevented from rotating by a torque bolt 525 that passes through clear bores in the lobe of the outer case of the clutch and a torque spacer 527 to threadably mount into the left hand surface of the left hand side of the plate 498L. Now referring to FIGS. 15 and 17, the outer case of the right hand overrunning clutch 523R is pivotally attached to an offset clevis 529by a pin 531 that is compressively held in the working extremity of the offset clevis 529. The offset clevis 529 is threadably and fixedly held upon the working end of a cylinder rod 533 of a ratchet cylinder 535 that is in turn pivotally attached to a base lug 537. The base lug 537 is rigidly affixed to the input surface of the right hand end of the lower cylinder bar 504. The stroke of the ratchet cylinder 535 is very short, rotating the case of the overrunning clutch 523R through only a small portion of a revolution, so in effect, the case does not rotate, but merely pivots back and forth upon its inner face. The internal mechanism of the pair of overrunning clutches 523L and 523R is set to prevent rotation of the shaft 529 when the ratchet cylinder 535 extends, but to rotate the shaft 519 when the cylinder retracts. In viewing FIG. 17, this yields a stepped and clockwise rotational motion to the shaft 519 and consequently to the pair of feed wheels 517. The outer circumference of each of the pair of feed wheels 517 is fixedly fitted with a friction tire 539, of such material so as to exhibit high friction with the banding paper 38.

Referring again to FIGS. 12 and 13, a pressure roller 541 is rotatably mounted between and at the upper end of a pair of pivot arms 543 that is in turn pivotally mounted upon a pair of pins 545. The pair of pins 545 pass through clear centrally located bores in the pair of pivot arms 543 to fixedly mount into the outboard surfaces of the pair of side plates 498L and 498R. The pressure roller 541 is urged into contact with the pair of friction tires 539 by a pair of small cylinders 547 (FIG. 15 also). The cylinders 547 are fixedly attached to the outboard sides of the side plates 498L and 498R so that a pair of small cylinder rods 549 can push against lower tabs 551 of the pivot arms 543. It is to be noted that the pair of small cylinders 547 is a single acting mechanism with no way to retract the pair of small cylinder rods 549. As a consequence, the pressure roller 541 is either urged into contact with the pair of friction tires539 or left in place without pressure.

The wireform paper guide assembly 484 is comprised of a transverse rod 552, an inlet lip 554, and a set of four wire tines 556. The inlet lip 554 is rigidly affixed to the output side of the transverse rod 552 through the intervening auspices of set of spacers 558. The set of spacers 558 do not interfere with slots formed in the output face of the transverse rod 552 that cooperate in accepting the set of four wire tines 556. Each of the set of four wire tines 556 is fixedly held at its bottom end by one of a set of set screws 560 that threadably mount through the transverse rod 552 to clamp the set of four wire tines 556 against the inlet lip 554. The inlet lip 554 is disposed vertically downward with its lower portion angled toward the input direction. The outer extremities of the transverse rod 552 are clampedly held upon the input surfaces of the sideplates 498L and 498R by a pair of finger clamps 557 that in turn are fixedly attached to the input surface of the lower portion of the side plates 498L and 498R. This assembly facilitates the loading and guidance of the banding paper 38 into the lower paper handling assembly 50. More specifically, the wire form paper guide 484 guides the banding paper 38 between the pressure roller 541 and the friction tires 539 of the ratchet feed assembly 482. When pressure is applied to the pair of small cylinders 547 the ratchet cylinder 535 is able to advance the banding paper 38 upward in steps. Pressure being withdrawn from the pair of small cylinders 547 permits banding paper 38 to pass through the assembly unimpeded.

The cutter assembly 486 is shown best in FIGS. 13–16 inclusive, and is comprised of a pickoff bar 562, a lateral guide bar 564, a lower blade 566, an upper blade 568, an upper blade holder 570, and a cutter cylinder 572.

The upper output edges of the side plates 498L and 498R are provided with a pair of notch-outs 574, rectangular in shape, as shown in FIG. 13. A vertical edge surfaces 575 of one of the notch-outs 574 is shown in dashed line behind the set of four wires tines 556, and the upper edge is coincident with the top surface of the lower blade 566. The pickoff bar 562 spans the full width of the pair of side plates 498L and 498R (FIG. 14), and is fixedly attached to the upper vertical edge surfaces of the notch-outs 574 through the intervening auspices of a pair of bar spacers 576 by a pair of dowel pins 578, and a pair of countersunk bolts 580. The pickoff bar 562 is provided with a pickoff wedge along its lower input edge that cooperates with the pressure roller 541 in maintaining the vertical direction of the banding paper 38. The upper surface of the pickoff bar 562 that is disposed between the inner surfaces of the pair of side plates 498L and 498R is recessed downwardly to cooperate in seating the lateral guide bar 564 therein. A set of three holes 582 (FIGS. 15 & 16) pass downwardly through the lateral guide bar 564 to cooperate with a set of three blind holes 584 that is spacedly provided in the upper recessed surface of the lateral guide bar 564. A set of three compression springs 586 is confined within these cooperating holes to bear against the bottom surface of the lower blade 566 that is in turn adjustably attached atop the lateral guide bar 564 by a set of four flat head screws 588 that pass through clear holes in the lateral guide bar 564 and threadably mount into the top surface of the pickoff bar 562. Integrally formed at the ends of the input surface of and protruding from the lateral guide bar 564 is a pair of lateral guides 590 (FIG. 15). The inwardly disposed surfaces of the pair of lateral guides angle upwardly inward to provide a measure of lateral guidance to the widest banding paper 38; it is to be noted that the top portions of the lateral guides 590 rise above the lateral guide bar 564 for a distance slightly larger than the thickness of the lower blade 566. Also, the upper blade 568 spans the lateral distance between the pair of side plates 489L and 489R to rest and slide upon the top surface of the pair of lateral guides 590. This provides a fixed vertical relationship between the upper blade 568 and the lateral guide bar 564. The set of four flat head screws 588 can be turned so that the lower blade 566 will be urged upward by the set of three compression springs 586 to come into fine cutting adjustment with the upper blade 568. The upper blade 568 is provided with a slanted cutting edge (FIG. 16); that is, the right hand side of the blade is slightly ahead of the left hand side so that the right hand side will overpass the lower blade 566 ahead of the left hand side to provide a scissors action to the shear cut of the banding paper 38.

The upper blade 568 is fixedly attached to the lower recessed surface of the upper blade holder 570. The upper blade holder 570 is in turn threadably and fixedly attached upon the working end of a rod 592 of the cutter cylinder 572. The cutter cylinder 572 is fixedly attached within the center input surface of the upper cylinder bar 502. The cutter cylinder 572 possesses a very short stroke that motivates the upper blade 568 in the output direction to fully overrun the cutting edge of the lower blade 566, and to withdraw it sufficiently to permit the easy passage of banding paper 38 but not to disengage the top surfaces of the pair of lateral guides 590. As the banding paper 38 passes upwardly through theopen cutter blades, it is guided in the output direction around a plastic bar 595 that is fixedly attached between the upper output edges of the pair of side plates 498L and 498R. The output side of the plastic bar 595 is provided with a flat surface to permit passage of the lower hand assembly 488.

Figure 16:
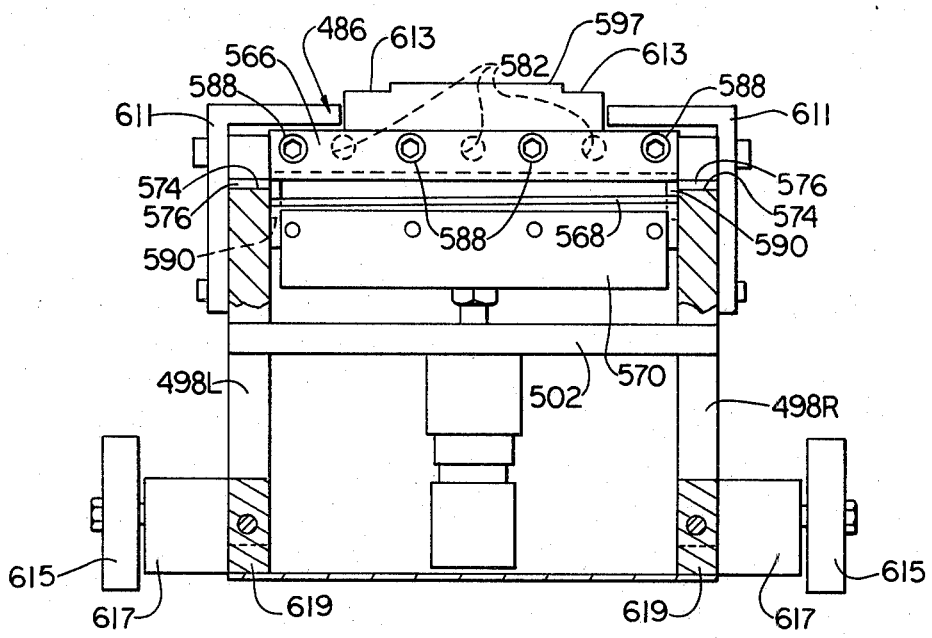
FIG. 16 is a view in section taken along the line 16—16 in FIG. 13.

The lower hand assembly 488 is shown in FIGS. 12, 13 and 16, and is comprised of a lower hand 597, an angle mount 599, a longitudinal guide mount 600, a longitudinal guide 601, and a lower hand cylinder 603. The lower hand 597 is composed of a plastic material displaying high lubricity surface qualities. Fixedly attached to the bottom surface of and a portion of the the lower input surface of the lower hand 597 is the angle mount 599 that is in turn rigidly affixed to the top edge of the longitudinal guide plate 600. The input surfaces of the vertical portion of the angle mount 599 and the longitudinal guide mount 600 lie in the same plane. The longitudinal guide mount 600 is provided with a cutout 605 in the lower edge thereof to accommodate the upper end of the lower hand cylinder 603. The longitudinal guide 601 is fixedly attached to the input surface of and toward the lower edge of the longitudinal guide mount 600. It extends laterally to the left and right of the longitudinal guide mount 600 to slidably cooperate with a pair of slots 607 of the pair of side plates 498L and 498R. The lower hand cylinder 603 is pin mounted to the lower cylinder bar 504 cooperating with the central notch 510 thereof. Vertically disposed, a cylinder rod 609 of the lower hand cylinder 603 is threadably and fixedly mounted into the center of the lower surface of the horizontally disposed flange of the angle mount 599. In this manner the lower hand cylinder 603 can displace the lower hand 597 upwardly as shown in dot-dash lines in FIGS. 12 and 13. The vertical disposition in the transverse plane of the lower hand assembly 488 is maintained by a pair of hand guides 611 (FIGS. 12 and 16). Each of the hand guides 611 is of angular form, fitting around the right and left hand output corners of the lower paper handling assembly 50 to be fixedly attached to the upper outboard surfaces of the the pair of side plates 498L and 498R. Inboard extremities of the hand guides 611 fit in close clearance along the sides of the lower hand 597. The banding paper 38 passes upwardly through the cutter assembly 486 and over the top of the lower hand 597 and is stretched with significant tension in the output direction. The lower hand is maintained in vertical disposition against such pressure by the longitudinal guide 601 working in the pair of slots 607 of the pair of side guides 498L and 498R. The output face of the lower hand 497 is provided with a pair of edge grooves 613 that cooperate with the extraction assembly 54 as will be described hereinafter.

The movable frame assembly 480 rises to its upper position during the operating cycle of the bundle banding machine 10 at such time when the stack of cartons 58 is present within the input station 22. When the stack of cartons 58 is comprised of the largest cartons, the input side of the lower paper handling assembly 50 can interfere with the output edge of the largest cartons, the input side of the lower paper handling assembly 50 can interfere with the output edge of the stack. This interference is prevented by a pair of wheels 615 that is rotatably mounted to the outboard ends of a pair of stub mounts 617 (FIGS. 12, 13 and 16). The pair of stub mounts 617 is rigidly affixed at its inboard ends to the outboard surfaces of a pair of auxiliary standoffs 619 that is in turn fixedly attached upon the upper input surface of the input extension 514 of the pair of side plates 498L and 489R. The pair of wheels 615 can roll downwardly along the output side of the stack of cartons 58 to move the cartons away from the input edge of a transfer table 621. The transfer table 621 is mounted on the lower paper handling assembly 50.

The transfer table 621 (FIGS. 6, 12 and 13) is a rectangular plate that is provided with a cutout 623 along its output edge to provide for free movement of the lower hand 597 and the banding paper 38. The input side of the transfer table 621 is bent downwardly at a slight angle to facilitate the transfer of a stack of cartons 58 from the input station 22. The lower input surface of the transfer table 621 is rigidly affixed to the horizontal flange of a continuous hinge 625, whose vertical flange is in turn fixedly attached to the upper input surface of the pair of auxiliary standoffs 619. The transfer table 621 is supported in horizontal disposition by a pair of stops 627 that is fixedly mounted in the top edges of the pair of side plates 498L and 498R. An angle member 629 is rigidly affixed across the underside of the transfer table 621 approximate to the cutter assembly 486 to prevent the banding paper 38 from curling under the transfer table 621 in the input direction.

Referring now to FIG. 10, the movable frame assembly 480 is provided with a trip arm 630 that is fixedly attached to the left hand surface of, and adjacent the input edge of the input extension 514 of the left hand side plate 498L. The trip arm 630 cooperates with a trip lever of a limit switch LS113, so that as the movable frame assembly 480 is in its down position, the circuit is made through LS113 that permits the pusher assembly 36 to operate. The limit switch LS113 is then a safety switch that prevents the pusher assembly 36 from running into the movable frame assembly 480. The limit switch LS113 is fixedly attached to the left side of the left hand horizontal member 99L of the auxiliary frame 93.

A trip arm 634 is clampedly mounted in cantilever form from the lower portion of the left hand member of the pair of guide rods 506 to cooperate with a trip lever 636 of the limit switch LS106 that is in turn fixedly mounted to the top surface of and adjacent the left hand end of the input carriage member 94 of the lateral adjustment frame 14. As the movable frame assembly 480 of the lower paper handling assembly 50 reaches it upper position, the circuit through LS106 is made which, through preset and sequential time delays, feeds banding paper 38, cuts off the banding paper 38, sends the lower paper hand assembly 488 up, and then withdraws (up) the upper hand 414 of the upper paper handling assembly 52, as will be described in greater detail hereinafter.

Output Assembly

Figure 18:
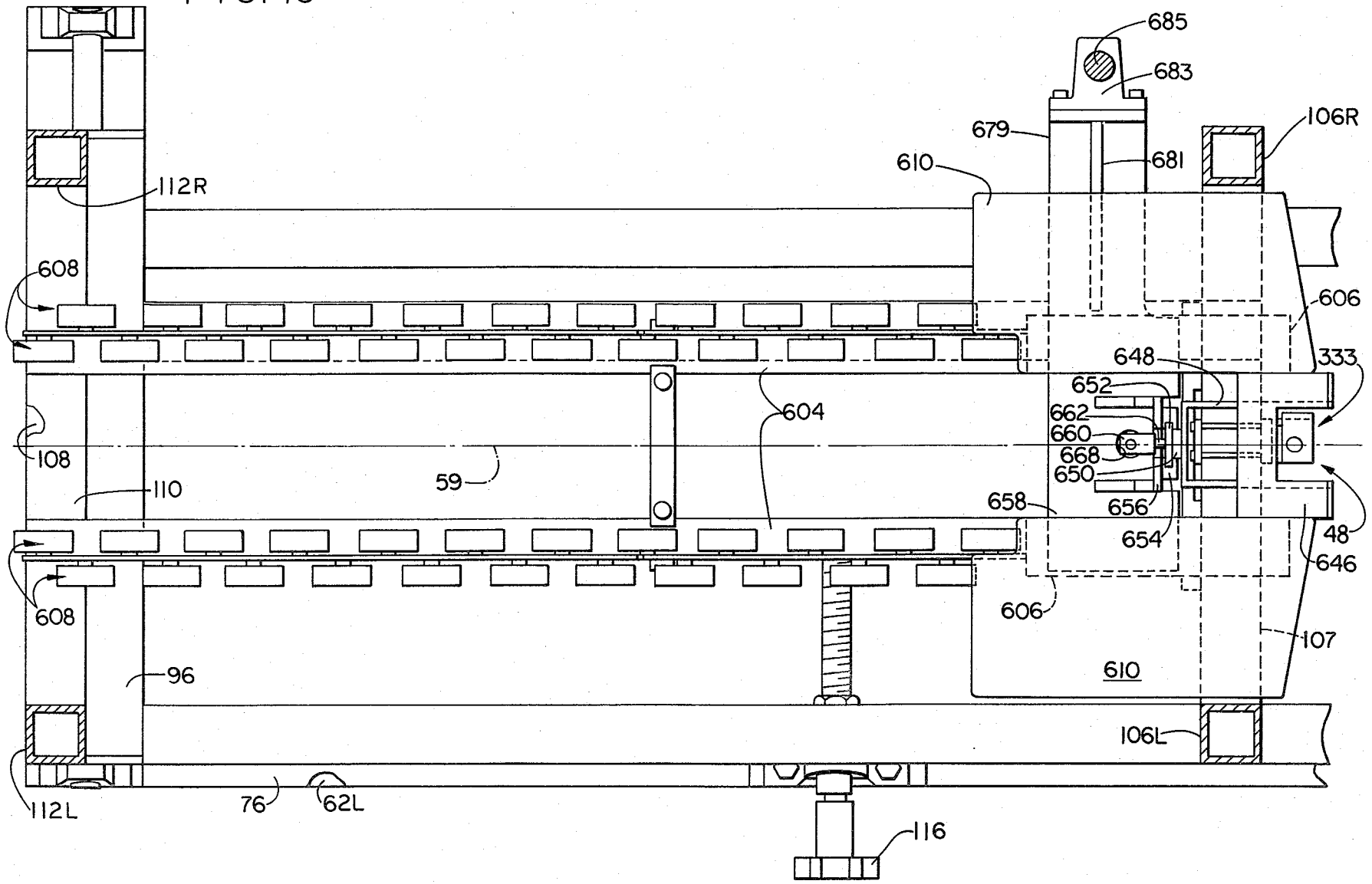
FIG. 18 is an enlarged view in section of the bundle banding and output portions of the machine taken along the line 18—18 in FIG. 1.

As already pointed out, the output assembly 26 is comprised of the extraction assembly 54, the backstop assembly 53 and the discharge roll conveyor 56. Referring now to FIGS. 1, 3 and 18, the roll conveyor 56 includes a pair of angle members 604 whose vertical flanges are disposed upwardly and whose generally horizontal flanges are disposed inboardly. Input ends of the angle members 604 are rigidly affixed to the output extremities of a pair of short tubes 606. The short tubes 606 are rigidly affixed across the top surface of the middle lateral brace 107 of the lateral adjustment frame 14 in narrowly spaced parallel relationship (FIG. 4). Input extremities of the short tubes 606 slightly overhang the input surface of the middle lateral brace 107 as shown in FIG. 18. Vertical flanges of the angle members 604 are severed near mid-span as indicated at 612 in FIG. 1, permitting the generally horizontal flanges to be bent downwardly at a small angle. Output ends of the generally horizontal flanges are rigidly affixed upon the top output surface of the output brace 110. A plurality of wheels 608 is rotatably mounted in staggered pattern along the length of the angle members 604. The stack of cartons 58A is supported upon a pair of support plates 610 that is in turn fixedly attached upon the top surfaces of the short tubes 606. Inboard extremities of the support plates 610 lie flush with the inboard surfaces of the short tubes 606, and outboard extremities thereof lie adjacent the input uprights 106L and 106R.

Referring now to FIGS. 4, 9 and 10, the extraction assembly 54 is comprised of an upper cleat or discharge presser assembly 638, a lower cleat or discharge pressure assembly 640, a tie bar assembly 642, and an extraction cylinder 644.

The lower cleat assembly 640 is shown in FIGS. 4, 10 and 18, and is comprised of a cleat plate 646, a support yoke 648, a slide spacer 650, a slide 652, a pair of slide rails 654, a slide mount 656, and a lower assembly plate 658. The cleat plate 646 is a rectangular plate exhibiting a large notch-out in its input side to fit around the lower assembly 333 of the secondary compressor assembly 48. The input edges thereof are turned upwardly to form cleats 616 to fit around the input edge of the stack of cartons 58A that is in the process of being banded. The cleat plate 646 is rigidly affixed upon the top edges of, and at the input ends of the support yoke 648. The base portion of the support yoke 648 is rigidly affixed in symmetrical arrangement to the slide spacer 650 that is in turn rigidly affixed to the upper input surface of the slide 652. The outwardly extending edges of the slide 652 cooperate with vertical grooves in the pair of slide rails 654 to provide mechanical retention in all directions save vertical. The pair of slide rails 654 is fixedly attached to the input surface of the slide mount 656 that is in turn rigidly affixed to the input edge of the horizontally disposed lower assembly plate 658. The slide mount 656 is provided with a large slot 618, centrally disposed, entering the top edge of the part and extending downwardly to the input edge of the lower assembly plate 658. This slot provides clearance for an attachment block 660 that is adjustably attached by means of a threaded rod 662 to the upper output surface of the slide 652. At assembly, the attachment block 660 is positioned upon the threaded rod 662 to cooperate with the distance between the slide 652 and the centerline of a lower clamp cylinder 664. The attachment block 660 is then fixedly attached to the working end of a cylinder rod 666 that communicates through a hole 668 in the lower assembly plate 658 with the lower clamp cylinder 664. The lower clamp cylinder 664 is in turn fixedly attached to the underside of the lower assembly plate 658. A set of four rod bearings 670 is fixedly attached in a rectangular pattern to the bottom surface of the lower assembly plate 658 as to form a symmetrical pattern about the centerline of the lateral adjustment frame 14. The set of four rod bearings 670 cooperate with a pair of bearing rods 672 that is suspended in spaced parallel and longitudinal disposition beneath the discharge roll conveyor 56. The input end of the pair of bearing rods 672 is fixedly attached with a pair of input rod holders 674 (FIG. 4) that is in turn fixedly attached to a cross bar 671. The cross bar 671 is rigidly and spacedly affixed to the underside of the pair of short tubes 606 and longitudinally located against the output surface of the middle lateral brace 107. The output end of the pair of bearing rods 672 is fixedly mounted in a pair of output rod holders 676 (FIG. 3) that is in turn fixedly attached to the outboard bottom surface of an output cross bar 677. The output cross bar 677 is clampedly and spacedly attached beneath the pair of angle members 604 of the output conveyor 56 adjacent the change in slope thereof (FIG. 1).

The lower assembly plate 658 extends outboardly to the right to a point just outside the confines of the lateral adjustment frame 14 to provide an attachment point for the tie bar assembly 642 (FIG. 4). The tie bar assembly 642 includes a vertical end plate 679 that is rigidly affixed upon the right hand extremity of the the lower assembly plate 658. A gusset plate 681 is rigidly affixed between the upper left hand surface of the end plate 679 and the right hand upper surface of the lower assembly plate 658 to rigidize the vertical disposition of the end plate 679. A pair of rod holders 683 is fixedly attached in vertical alignment upon the right hand surface of the end plate 679 that in turn fixedly accommodates a vertical rod 685. The vertical rod 685 rises upwardly to cooperate with a long rod bearing 687. The long rod bearing 687 is retained in transverse floating form upon the right hand surface of an upper end plate 689 by a set of four machine screws 691.

The upper cleat assembly 638 is shown in FIGS. 3, 4 and 9 and is comprised of an upper cleat plate 693, an upper cleat cylinder 695, an upper assembly plate 697, and an assemblage of other parts similar to the parts of the lower cleat assembly 640. The parts of the upper cleat assembly 638 differ from the parts of the lower cleat assembly 640 insofar as to cooperate with the inverted assembly thereof with respect to the lower cleat assembly 640, and the slightly larger vertical dimensions required in the upper assembly. The upper cleat assembly 638 is mounted upon the upper assembly plate 697 that also extends laterally to the right to rigidly attach to the left hand surface of the upper end plate 689. This attachment is likewise rigidized by the incorporation of an upper gusset plate 698. The upper assembly plate 697 is mounted upon a pair of upper rods 700 that is in turn fixedly and clampedly mounted below the pair of lower stringers 130L and 130R of the vertical adjustment frame 16 in the same spaced parallel and longitudinal orientation as the pair of bearing rods 672 of the lower cleat assembly 640.

The base of the extraction cylinder 644 is pin mounted to a lug 702 (FIGS. 3 and 9) that is in turn rigidly affixed to the top surface of an output flat 704 that is in turn clampedly attached to the bottom surface of and at the output end of the pair of lower stringer 130L and 130R. The working end of a rod 706 of the extraction cylinder 644 is fixedly and threadably provided with a rod clevis 708 that is in turn pinned to the upper extremity of a rod lug 710. The rod lug 710 is fixedly and spacedly attached to the upper output surface of the upper assembly plate 697. The cylinder 644 and its attachments are disposed along the centerline of the lateral and vertical adjustment frames 14 and 16 respectively.

The extraction cylinder 644 motivates the upper cleat assembly 638 in longitudinal displacement upon the pair of upper rods 700, while the tie bar assembly 642 transfers this same displacement to the lower cleat assembly 640 that consequently moves upon the pair of bearing rods 672. The tie bar assembly 642 provides coupling between the upper and lower cleat assemblies 638 and 640, respectively, regardless of the amount of vertical displacement required by the set of the vertical adjustment frame 16. The lower and upper cleat cylinders 664 and 695 are actuated simultaneously to motivate the upper and lower cleat plates 693 and 646, respectively, in opposition to each other to provide a clamping force upon the stack of cartons 58A.

The backstop assembly 63 is shown in FIGS. 1, 10, 27 and 28, and is comprised of a right hand stop assembly 631 and a left hand stop assembly 633. The right and left hand stop assemblies 631 and 633, respectively, are of identical construction, save for mirror image installation, so that they work in opposition to each other as a cooperating pair. The right hand stop assembly 631 incorporates a slide mount plate 635 and a slide plate 637. The left hand input surface of the slide mount plate 635 is clampedly mounted to the output face of the right hand input upright 106R so that it hangs outboardly in cantilever form to the right of the bundle banding machine 10. Its lower edge is mounted just above the pair of support plates 610 of the output assembly 26. The clamped attachment of the slide mount plate 635 incorporates an upper clamp bar 639 and a lower clamp bar 641. Both bars 639 and 641 are horizontally disposed in transverse disposition across the input face of, and long enough to more than span the width of the input upright 106R. A hole is provided in each overhanging end of the upper clamp bar 639 to cooperate with a pair of long bolts 643 that pass horizontally therethrough. The pair of long bolts 643 lie adjacent each side of the right hand input uprights 106R to threadably mount in the upper left hand input surface of the slide mount plate 635. Likewise, the lower clamp bar 639 cooperates with a pair of long bolts 645 that threadably attach into the lower left hand input surface of the slide mount plate 635. The spacing between the upper and lower clamp bars 639 and 641, respectively, yields substantial torque support to the cantilever disposition of the slide mount plate 635.

A set of four rod holders 647 is fixedly attached in rectangular pattern upon the output surface of, and favoring the inboard end of, the slide mount plate 635. The set of four rod holders 647 clampedly hold in horizontal and lateral disposition a pair of bearing rods 649.

A pair of long bearing blocks 651 cooperate by means of internal ball bearings with the pair of bearing rods 649, and is in turn fixedly attached to the input surface of the slide plate 637. The slide plate 637 is motivated back and forth upon the pair of bearing rods 649 by means of a backstop cylinder 653. The base of the backstop cylinder 653 is integrally provided with a clevis mount that is pin mounted to the output end of a lug 655 that is in turn rigidly affixed to the output surface of and at the left hand edge of the slide mount plate 635. The horizontally and laterally disposed cylinder 653 lies parallel to the centerline of the slide mount plate 635 to cooperate with a slide plate lug 657 that is in turn rigidly affixed to the input surface of and at the inboard edge of the slide plate 637. The free extremity of the slide plate lug 657 is pivotally attached by means of a clevis pin to a rod clevis 659 that is in turn fixedly and threadably mounted to the working end of a cylinder rod 661 of the backstop cylinder 653.

The slide plate 637 provides mounting and lateral movement for a stop plate assembly 663. The slide plate 637 is provided with a lateral adjustment mount 665 that is fixedly attached along the top edge of the slide plate 637 in such disposition that it extends therefrom in the input direction as a cantilever plate. A short guide 667 is fixedly attached upon the top surface of and along the input edge of the lateral adjustment mount 665 to provide mounting and lateral guidance for the stop plate assembly 663.

The stop plate assembly 663 is comprised of an adjustment plate 669, a long guide bar 678, a longitudinal slide guide plate 680, and a backstop plate 682. The adjustment plate 669 (FIG. 27) is an L-shaped plate whose lateral leg is provided with a slot 684. A pair of bolts 686 through the slot 684 to threadably mount into two holes of a set of three tapped holes 668 (only one of which is shown) provided in the lateral adjustment mount 665. By selecting two adjacent holes out of the set of three, the range of the lateral placement of the adjustment plate 669 is increased. The slot 684 and the input edge of the adjustment plate 669 cooperate in close tolerance against the short guide bar 667 to keep the adjustment plate 669 in lateral and square position with respect to the lateral adjustment frame 14. The long guide bar 678 is fixedly attached upon the top surface of and along the outboard edge of the longitudinal leg of the adjustment plate 669. The longitudinal leg of the adjustment plate 669 is also provided with a set of three tapped holes 690, only one of which shows in FIG. 27.

The slide plate 680 is in large respect rectangular in plan form, save for the inboard edge that angles slightly inboardly from the input edge to near the output end of the piece. Also, the left hand output corner exhibits a generous radius. A slot 692 is provided adjacent the right hand edge of the slide plate 680 through which a pair of bolts 694 passes to threadably mount into two adjacent holes of the set of three tapped holes 690 of the adjustment plate 669. The slot 692, the pair of bolts 694, and the outboard edge of the longitudinal leg of the adjustment plate 669 cooperate in close tolerance with the long guide bar 678 to provide proper longitudinal orientation to the slide plate 680. Again, by selecting two adjacent holes out of the set of three tapped holes 690, the range of the longitudinal placement of the longitudinal slide guide 680 is increased.

The backstop plate 682 is formed from a rectangular piece of sheet stock to form an L-shaped part. The vertex of the right angle of the part exhibits a generous radius. The top edge of the longitudinal leg and a small portion of the top edge of the lateral leg of the backstop plate 682 is cut down to receive the longitudinal slide guide 680 to which it is rigidly affixed. The top surface of the slide guide 680 and the top edge of the lateral leg of the backstop plate 682 consequently lie in the same horizontal plane. Also, the lateral leg of the stop plate 682 is placed at the terminus of the tapered inboard edge of the longitudinal slide guide 680. The output surface of the backstop plate 682 adjacent to the vertical inboard edge thereof is tapered so that the inboard input edge is fairly thin. The left hand stop assembly 633 of the backstop assembly 53 is identical in form to the right hand stop assembly 631 except in mirror image as previously stated. The left hand stop assembly 633 is likewise clampedly affixed to the left hand input upright 106L of the lateral adjustment frame 14 in direct opposition to the right hand stop assembly 631.

The backstop cylinders 653 provide for extraction of the backstop plates 682 to allow for removal of the banded stack of cartons 58A and the insertion into the banding station 24 of the new stack of cartons 58. The tapered inboard edges of the backstop plates 682 assure proper entrance of the plates between the stacks of cartons at 58A and 58B (FIG. 1). The pair of bolts 686 and the slot 684 of the adjustment plate 669, and the pair of bolts 694 and the slot 692 of the longitudinal slide guide 680, provide lateral and longitudinal adjustment of the backstop plates 682 to cooperate with different size cartons. The tapered inboard edge of the longitudinal slide guides 680 assist in directing the stack of cartons 58A along the centerline of the lateral adjustment frame 14. It should be noted that the stroke of the backstop cylinder 653 is such that as the cylinder retracts, the right hand stop plate assembly 663 will move outboardly to a point adjacent to the vertical members of the extraction assembly 54, but will not touch it, leaving the extraction assembly 54 free to operate as will be described hereinafter.

Operation

Figure 29:
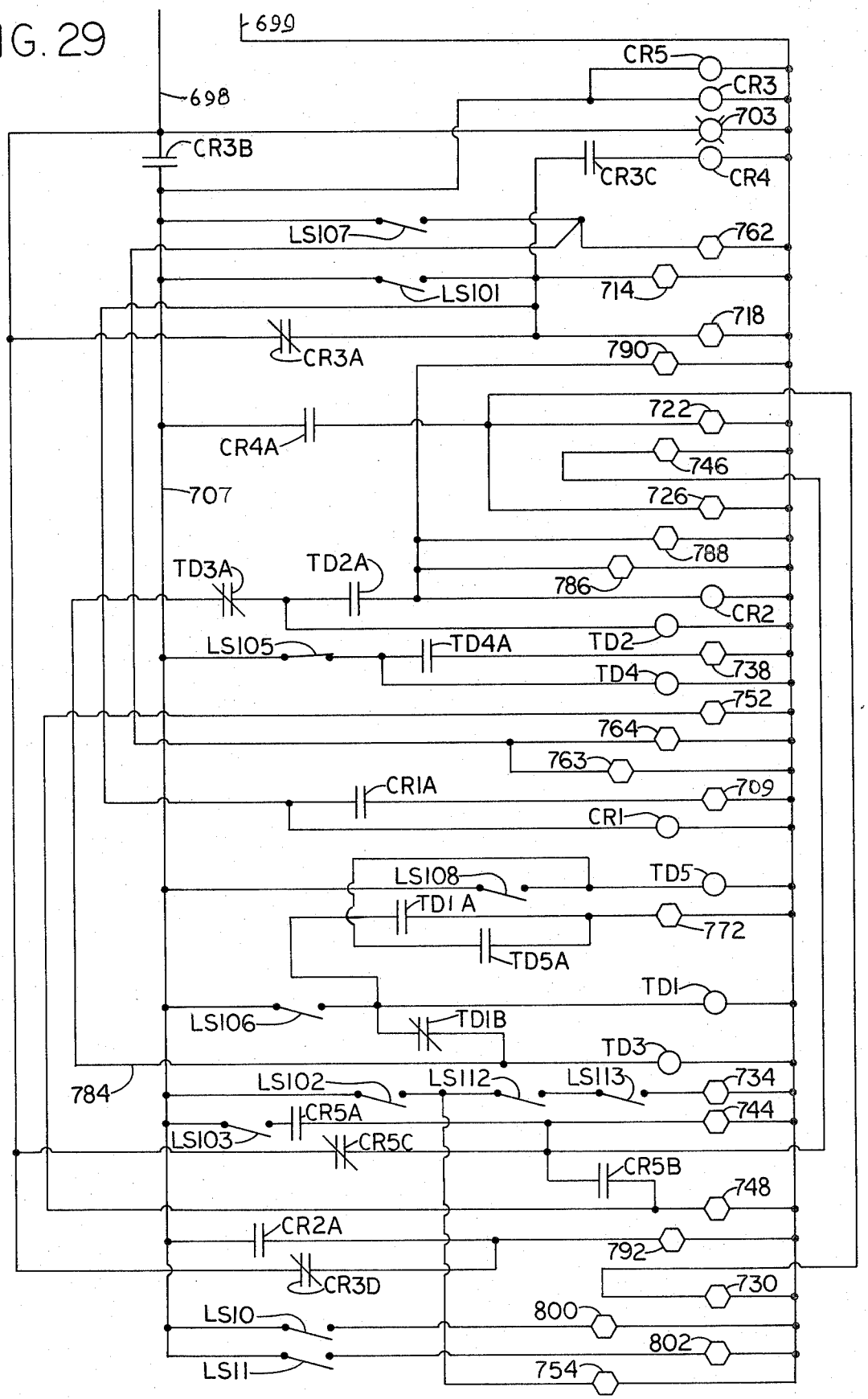
FIG. 29 is a schematic view of electrical connections of the machine.
Figure 30:
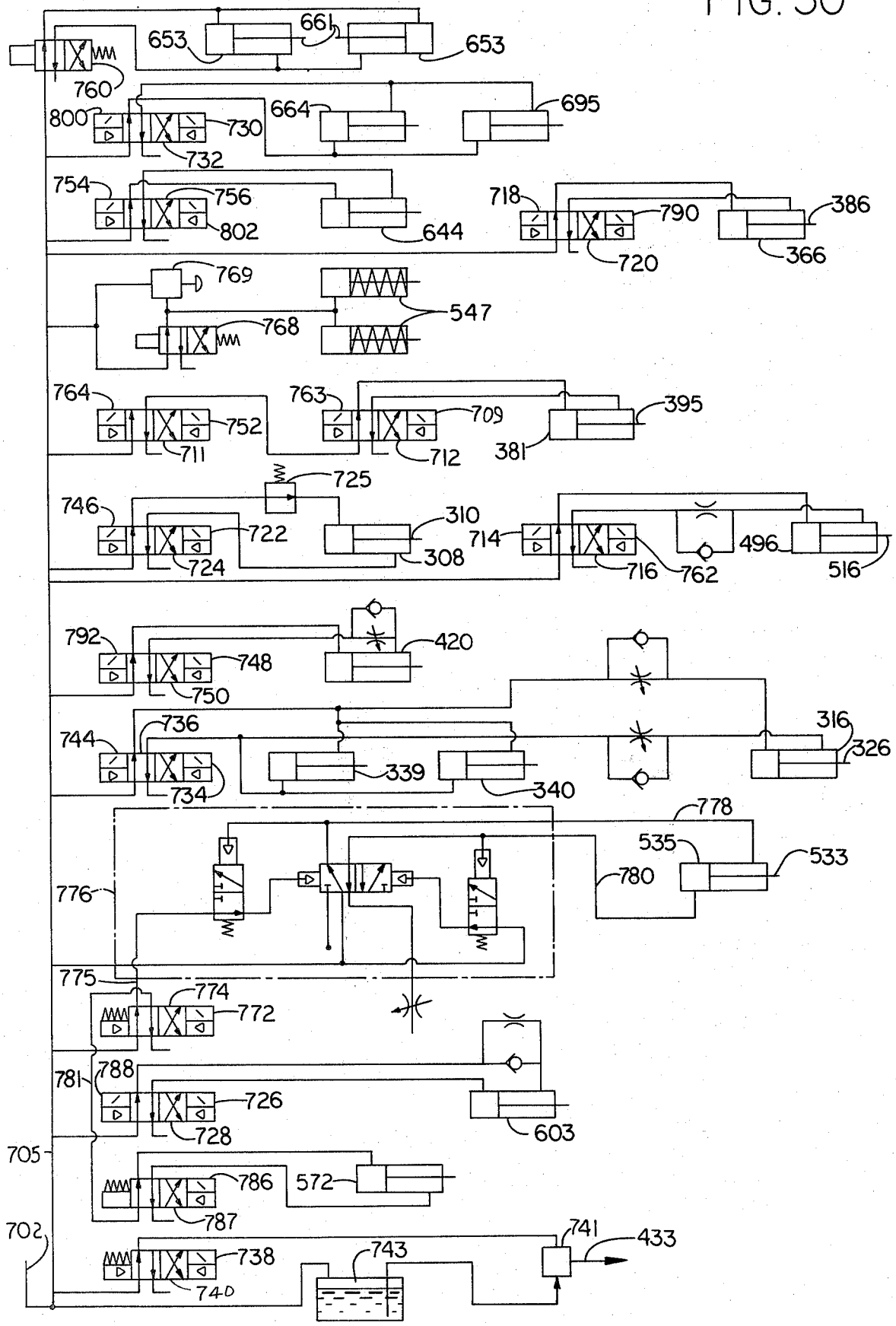
FIG. 30 is a schematic view of pneumatic connections of the machine.

Operation of the machine will now be described with reference to FIGS. 29 and 30, which show electrical and pneumatic connections, respectively, of the machine, and FIGS. 19–24, which show progressive stages of operation of the machine. Electric power is supplied through leads 698 and 699 (FIG. 29). When the leads 698 and 699 are energized, a pilot lamp 703 is lighted. Air under pressure is supplied through an air line 702 to an air pressure main 705 (FIG. 30).

Operation of the machine is instituted when a stack 58 of flattened articles such as flattened cartons, is advanced into engagement with the trip arm 243 (FIG. 8) of the limit switch LS101 to close the contacts thereof. Closing of the contacts of the limit switch LS101 permits energizing of a main lead 707 and control relays CR3 and CR5 by a circuit from the lead 698 through normally closed contacts CR3A of the control relay CR3. Energizing of the control relay CR3 closes contacts CR3B thereof to cause continuing energizing of the main lead 707. Energizing of the control relay CR3 also closes contacts CR3C thereof to energize a relay CR4 to close contacts CR4A thereof. Energizing of the control relay CR3 also opens contacts CR3D and the contacts CR3A. Energizing of the control relay CR5 closes contacts CR5A and CR5B and opens contacts CR5C thereof. Closing of contacts of the limit switch LS101 also energizes a control relay CR1 to close contacts CR1A thereof and energize a solenoid 709. At this time a clamp pressure valve 711 is in its other position. The solenoid 709 advances a valve 712 to the position shown in FIG. 30 to cause advance of the cylinder rod 395 of the clamp cylinder 381 and closing of the clamp 379 (FIG. 9) so that the clamp 379 moves from the position shown in full lines in FIG. 19 to the position shown in dot-dash lines at 379A at which the clamp 379A grips an end portion 796 of the banding paper or material 38. Closing of the contacts of the limit switch LS101 energizes a solenoid 714 to advance a valve 716 to its other position to cause withdrawal of the cylinder rod 516 of the lower feed cylinder 496 to cause lowering of the movable frame assembly 480 (FIG. 13). Closing of contacts of the limit switch LS101 also energizes a solenoid 718 of a valve 720 and moves the valve 720 to its other position to withdraw the cylinder rod 386 (FIG. 9) of the cylinder 366 to raise the clamp assembly 352 so that the upper end portion 796 of the web of banding paper is drawn upwardly to the position shown in FIG. 20 and a section of the banding paper is exposed as shown at 38A. Closing of the contacts CR4A of the control relay CR4 energizes a solenoid 722 of a valve 724 to advance the valve 724 to the position shown to cause advance of the piston rod 310 of the cylinder 308 to lower the primary compressor 34 (FIG. 5). A pressure regulator valve 725 limits the compressive force of the primary compressor 34. Closing of the contacts CR4A energizes a solenoid 726 of a valve 728 to advance the valve 728 to the position shown to cause withdrawal of the cylinder rod of the cylinder 603 to cause lowering of the lower hand 597 (FIG. 13). Closing of the contacts CR4A of the control relay CR4 also energizes a solenoid 730 of a valve 732 to advance the valve 732 to the position shown at which the cylinder rods of the cylinders 664 (FIG. 10) and 695 (FIG. 9) are advanced and the cleat assemblies 638 and 640 engage a banded stack at the station 58A.

When the primary compressor 34 (FIG. 1) is lowered, the limit switch LS102 (FIG. 5) is closed. When the clamp assembly 352 (FIG. 9) is lowered, the limit switch LS112 is closed. When the movable frame assembly 480 (FIG. 10) is in lowered position, the limit switch LS113 is closed. When the limit switches LS102, LS112, and LS113 are all closed, a solenoid 734 of a valve 736 is energized to advance the valve 736 to the position shown. When the valve 736 is in the position shown, the cylinder rod 326 of the cylinder 316 (FIGS. 5 and 8) is advanced to advance the pusher assembly 36 to advance the stack of cartons from the position shown at 58 in FIG. 20 to the position indicated at 58A in FIG. 21 and cause the banding paper 38 to surround three sides of the stack. When the valve 736 is in the position shown, piston rods of the cylinders 339 (FIG. 10) and 340 (FIG. 9) are withdrawn to withdraw the head members 343 and 346. Closing of the contacts of the limit switch LS102 energizes a solenoid 754 of a valve 756 to advance the valve 756 to its other position to cause retraction of the rod of the extraction cylinder 644 (FIGS. 1 and 9) and advance of the banded stack from the station 58A to the station 58B (FIG. 1). From the station 58B, the banded stack progresses down the discharge roll conveyor 56 through the station 58C to be discharged from the machine when advanced onto the sloping portion of the discharge roll conveyor 56 by action of the next banded stack arriving at the station 58B.

When the pusher assembly 36 reaches about the middle of its stroke, the limit switch LS105 is instantaneously opened to de-energize a time delay relay TD4. Contacts TD4A of the time delay relay TD4 open to de-energize a solenoid 738 to permit advance of a valve 740 to its other position to permit release of a glue valve 741 to permit discharge of a glob 742 of glue from the glue tube 433 and the glue nozzle 431, as shown in FIG. 21. The glue is advanced to the valve 741 from a glue tank 743. After a time delay, the time delay relay TD4 acts to close the contacts TD4A stopping discharge of glue.

When the rod of the extraction cylinder 644 is fully retracted, a valve operator 758 which travels with the upper assembly plate 697 (FIG. 9) engages an operator of a valve 760 (FIG. 1) to advance the valve 760 to the position shown in FIG. 30 to cause extension of the rods 661 of the cylinders 653 and extension of the backstop plates 682. When the valve operator 758 is free of the operator of the valve 760, the valve 760 is in its other position and the backstop plates 682 are withdrawn. The cylinder rod of the extraction cylinder 644 travels more rapidly than the rod of the cylinder 316 of the pusher assembly 36 so that the backstop plates 682 are advanced before the cylinder rod of the pusher assembly reaches the end of its stroke.

When the pusher assembly 36 reaches the end of its stroke, the limit switch LS103 closes. The banding paper 38 is drawn out and caused to surround three sides of the stack 58A as shown in FIG. 21. The stack at the station 58A is pushed against the backstop plates. and the backstop plates 682 are in the position shown in FIGS. 27 and 28 to provide a surface against which the stack 58A is advanced. Closing of the limit switch LS103 engages a solenoid 744 of the valve 736 to advance the valve 736 to its other position and cause retraction of the rod 326 of the cylinder 316 (FIG. 5) and advance of the rods of the cylinders 339 and 340 (FIGS. 10 and 9) to cause advance of the head members 343 and 346 to the position shown in FIG. 21 to hold the banding paper 38 in position. Closing of the limit switch LS103 energizes a solenoid 746 of the valve 724 to advance the valve 724 to its other position to cause retraction of the rod 310 of the cylinder 308 and to raise the pressure plates 296 (FIG. 5). Closing of the contacts of the limit switch LS103 energizes a solenoid 748 of a valve 750 to advance the valve 750 to the position shown to cause advance of the rod of the cylinder 420 (FIG. 9) and lowering of the upper head assembly 354 to advance the upper hand to the position shown at 414L in dot-dash lines in FIG. 22. The upper hand 414 is provided with a central upright slot 900 (FIGS. 22 and 24A) which permits the upper hand 414 to advance over the glue glob 742. Closing of the limit switch LS103 energizes a solenoid 752 of the valve 711 to advance the valve 711 to the position shown at which there is no pressure on the clamp cylinder 381 and the clamp 379 (FIG. 9) is released while remaining in closed position so that an end portion 796 of the banding paper 38 can be withdrawn from the clamp 379 to be folded against a face of the stack 58A as indicated at 796A.

When the upper hand assembly 354 is lowered, the limit switch LS107 (FIG. 9) is closed. Closing of the limit switch LS107 energizes a solenoid 762 of the valve 716 to advance the valve 716 to the position shown to cause advance of the cylinder rod 516 of the cylinder 496 and to cause raising of the movable frame assembly 480 (FIG. 13) to the position shown in FIG. 23. When the limit switch LS107 is closed, a solenoid 763 of the valve 712 is energized to advance the valve 712 to its other position to cause withdrawing of the rod 395 of the cylinder 381 to open the clamp 379 (FIG. 9). In addition, when the limit switch LS107 is closed, a solenoid 764 of the valve 711 is energized to advance the valve 711 to its other position at which pressure can be impressed on the valve 712 for putting pressure on the cylinder 381 of the clamp 379.

When the movable frame assembly 480 is in raised position, the limit switch LS106 (FIG. 10) is closed. In addition, a valve actuating collar 766 (FIG. 13) mounted on one of the rods 506 engages an actuator of a valve 768 to advance the valve 768 to the position shown in FIG. 30 at which air under pressure is directed to the cylinders 547 (FIGS. 13 and 15) to put pressure on the pressure roller 541 to permit feeding of the paper band 38. A manually operated valve 769 is provided for manual feeding of air under pressure to the cylinders 547.

Closing of the limit switch LS106 energizes a time delay relay TD1. When the time delay relay TD1 is energized, contacts TD1A thereof close and contacts TD1B thereof open. Closing of the contacts TD1A energizes a solenoid 772 to advance a valve 774 to the position shown at which air under pressure is directed along a line 775 to a pulsating valve unit 776. When air under pressure is supplied to the line 775 of the pulsating valve unit 776, the unit 776 supplies alternating pulses of air under pressure to lines 778 and 780. The lines 778 and 780 are connected to the ratchet cylinder 535 (FIGS. 13 and 17) and cause alternating advance and retraction of the cylinder rod 533 of the ratchet cylinder 535 and feeding of the paper band 38 until sufficient paper is advanced for cutoff. When there has been sufficient time for such feeding of paper, the time delay relay TD1 acts to open the contacts TD1A to de-energize the solenoid 772 and permit the valve 774 to return under spring pressure to its other position and stop advance of the paper band 38. When the valve 774 is in its other position, air under pressure is supplied to a line 781. When the time delay relay TD1 acts, it also closes the contacts TD1B.

Figure 19:
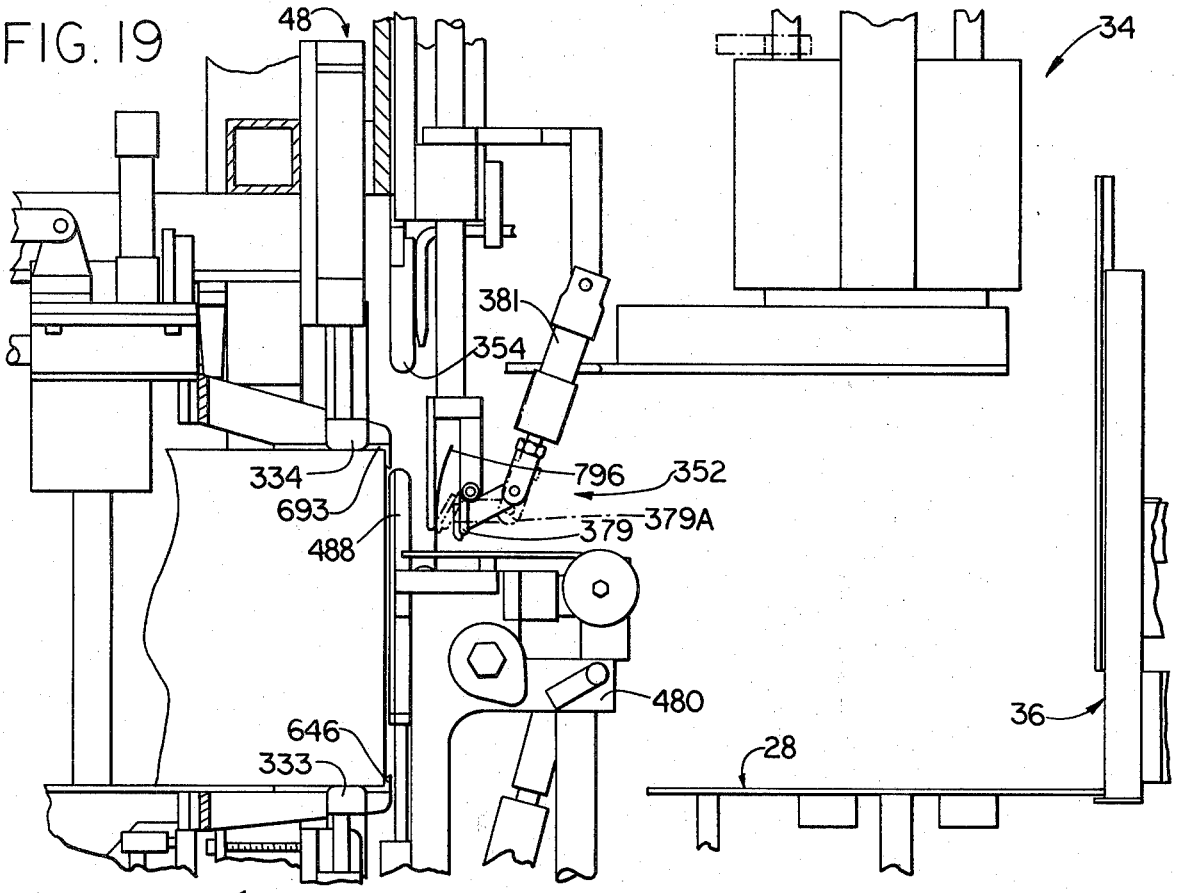
FIGS. 19 through 24 are schematic views in side elevation depicting the sequential operation of the bundle banding machine.
Figure 22:
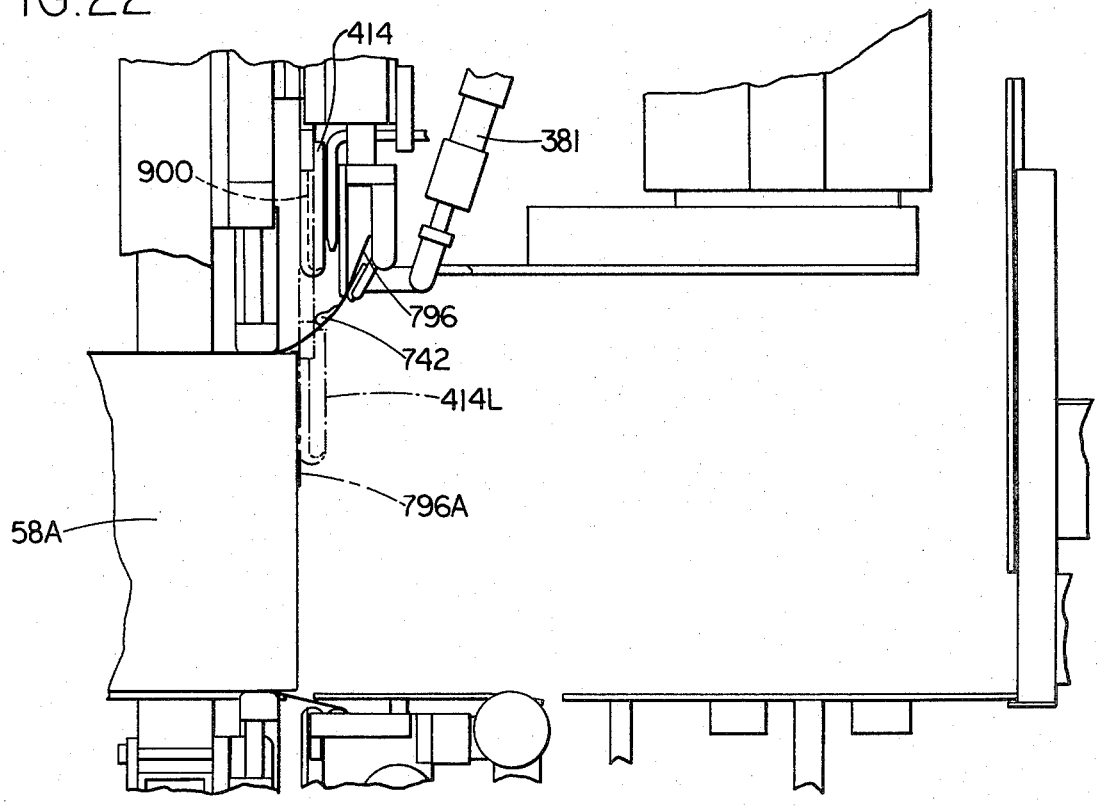
Figure 24:
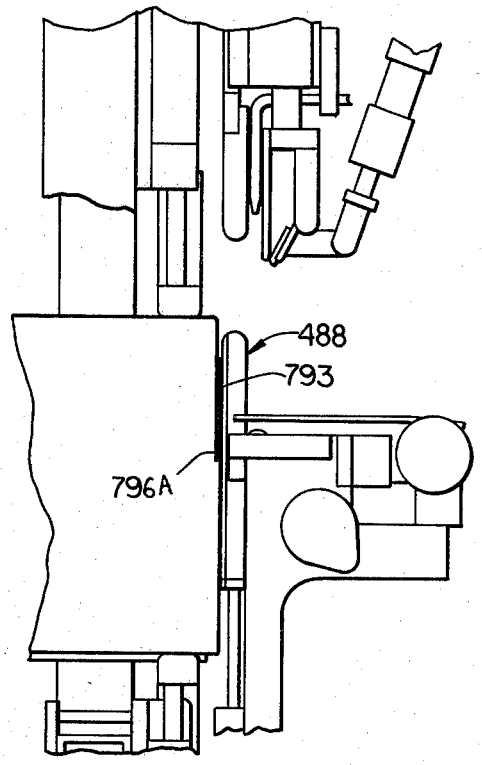
Figure 24A:
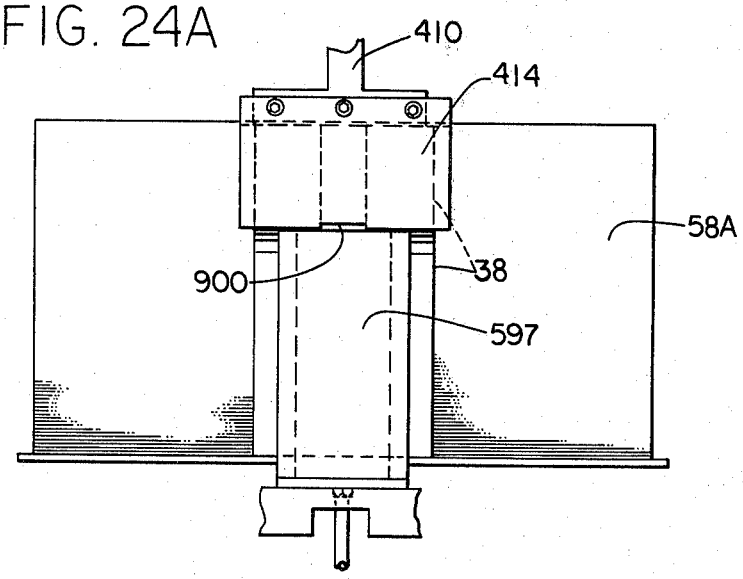
FIG. 24A is a view in section taken on the line 24A—24A in FIG. 23.
Figure 25:
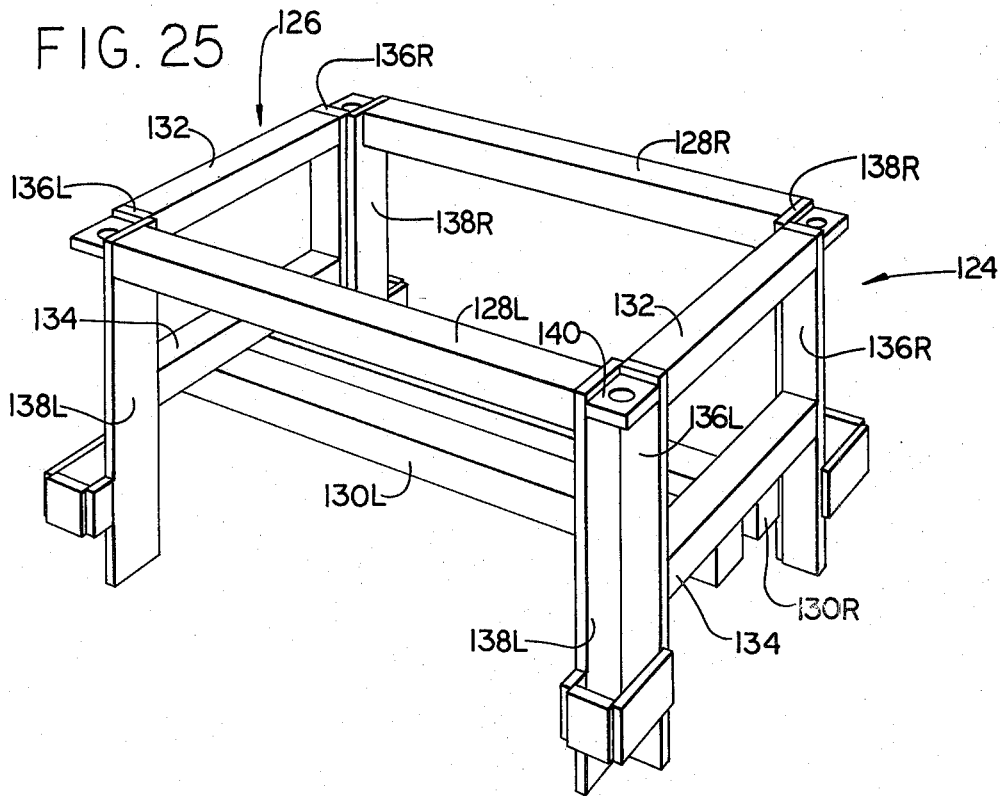
FIG. 25 is a fragmentary perspective view of an upper input frame of the machine.
Figure 26:
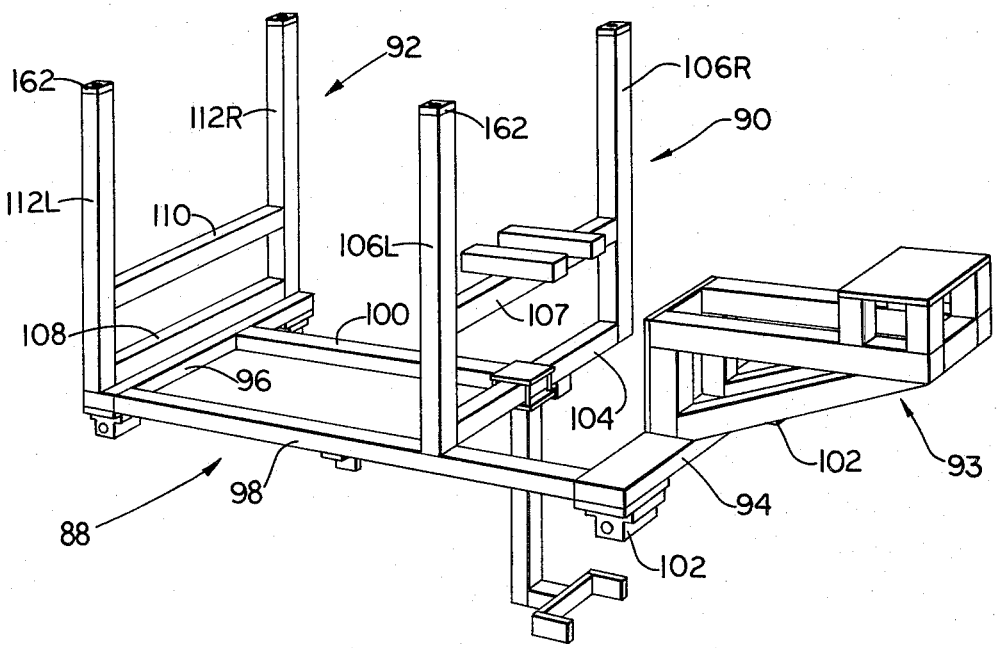
FIG. 26 is a fragmentary perspective view of an input frame of the machine.
Figure 27:
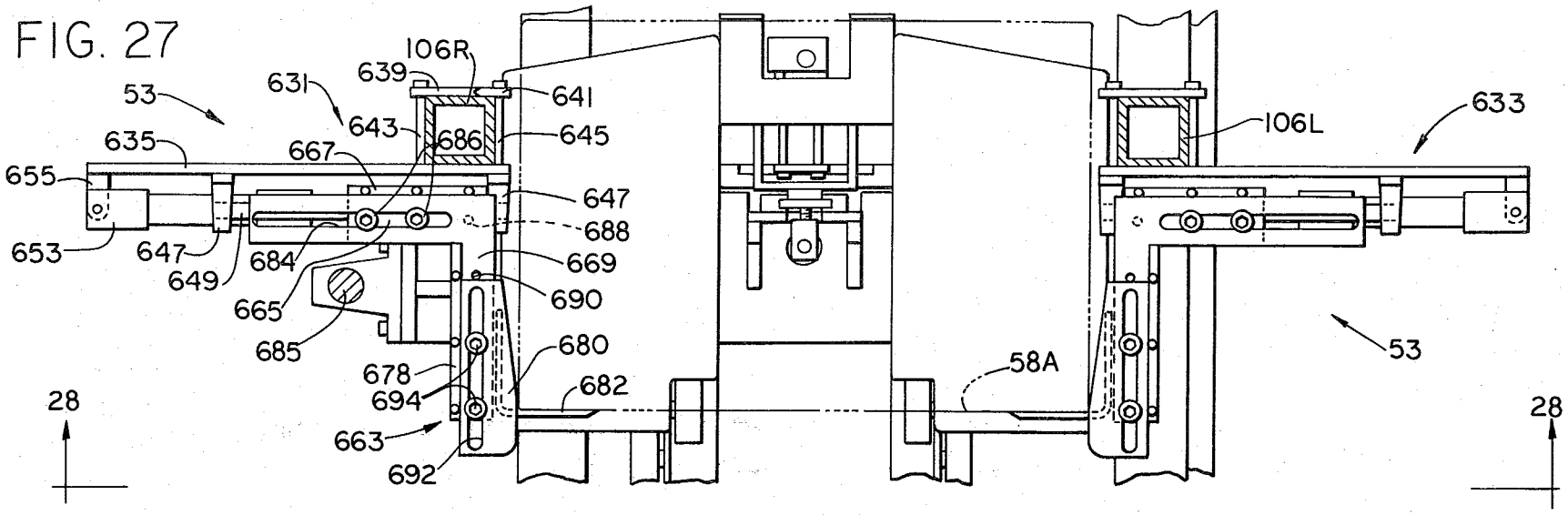
FIG. 27 is an enlarged view in section taken on the line 27—27 in FIG. 1.
Figure 28:
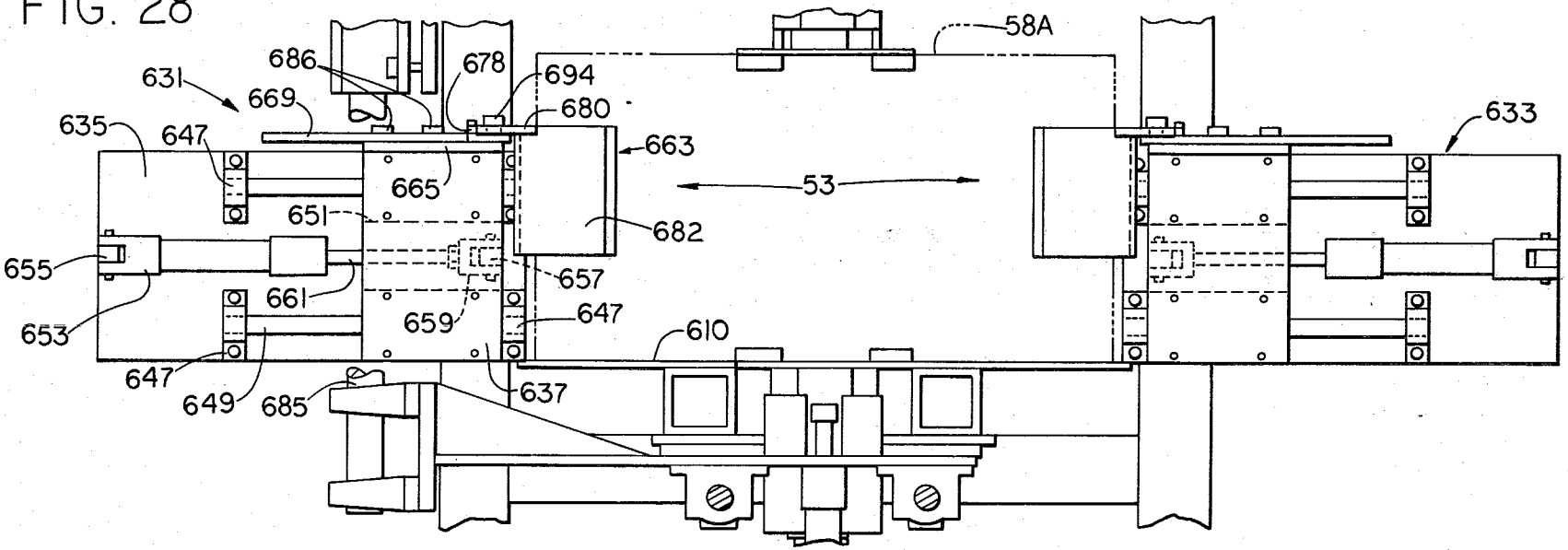
FIG. 28 is a view in section taken generally on the line 28—28 in FIG. 27.

Closing of the contacts TD1B causes energizing of a time delay relay TD3 and of a lead 784. Contacts TD3A of the time delay relay TD3 open when the time delay relay TD3 is energized and then close after a time delay to energize a time delay TD2. Energizing of the time delay relay TD2 causes closing of contacts TD2A. Closing of the contacts TD2A energizes a solenoid 786 of a valve 787 to advance the valve 787 to the position shown at which the rod of the cylinder 572 (FIG. 13) is extended to cause advance of the upper blade 568 and cutoff of the banding paper 38. Closing of the contacts TD2A energizes a solenoid 788 of the valve 728 to advance the valve 728 to its other position and cause extension of the rod of the cylinder 603 and raising of the lower hand assembly 488 (FIGS. 13 and 24). Closing of the contacts TD2A causes energizing of a solenoid 790 of the valve 720 to advance the valve 720 the position shown and cause advance of the cylinder rod 386 of the cylinder 366 and lowering of the clamp assembly 352 (FIGS. 9 and 19). Closing of the contacts TD2A energizes a contact relay CR2 to close contacts CR2A thereof. Closing of the contacts CR2A energizes a solenoid 792 of the valve 750 to advance the valve 750 to its other position to cause retraction of the rod of the cylinder 420 (FIG. 9) and raising of the upper hand assembly 354. As the hand assemblies 488 and 354 move upwardly, an end portion 793 of the paper band 38 is advanced against a downwardly hanging portion 796A with the glue glob 742 thereon as shown in FIGS. 22 and 24. Following completion of these steps, the contacts TD2A open at the end of the period of action of the time delay relay TD2.

When the clamp assembly 352 has been lowered, the collar and trip arm 406 (FIG. 9) engages an actuator 794 of a limit switch LS108 to close contacts thereof. Closing of the contacts of the limit switch LS108 energizes a time delay relay TD5. When the time delay relay TD5 is energized, contacts TD5A thereof are closed to energize the solenoid 772 and start a second paper feed in the manner already described. The second paper feed is into the clamp 379 (FIG. 19). When sufficient paper has been fed to form the end portion 796, the contacts TD5A open to de-energize the solenoid 772 permitting the valve 774 to return to its other position stopping action of the cylinder 535 and stopping paper advance.

Then, when a new stack is ready for advance into the machine, contacts of a switch LS10, which is controlled by the stack forming machine (not shown in detail) which accumulates the stack, close to energize a solenoid 800 of the valve 732. Energizing of the solenoid 800 causes the valve 732 to advance to its other position to cause retraction of the rods of the cylinders 664 and 695 (FIGS. 10 and 9) to retract the cleat assemblies 638 and 640. After a time delay, a switch LS11, also controlled by the stack forming machine, closes to energize a solenoid 802 of the valve 756 to advance the valve 756 to the position shown to cause advance of the rod of the cylinder 644 and return of the extraction assembly 54 to the right as shown in FIG. 1 to position for the cleat assemblies to engage the freshly banded stack 58A, and the machine is ready for the next cycle.

The machine illustrated in the drawings and described above is subject to structure modification without departing from the spirit and scope of the appended claims.

Having described our invention, what we claim as new and desire to secure by Letters Patent is:

1. A machine for wrapping a band around a stack of flat articles which comprises a band guiding assembly and a clamp assembly at a banding station, means for advancing an end portion of a strip of banding material from the band guiding assembly to the clamp assembly, clamp means mounted on the clamp assembly, means for closing the clamp means on the end portion of the strip of banding material, means for separating the clamp assembly from the band guiding assembly to provide an exposed section of the strip of banding material, means for advancing the stack against the exposed section of the strip of banding material to draw the banding material around three sides of the stack, the means for advancing the stack against the exposed section of the strip of banding material including a pusher member and means for advancing the pusher member to advance the stack from an input station to the banding station, the machine including input presser means at the input station engaging the stack as the stack is advanced against the exposed section of the strip of banding material, banding presser means at the banding station, means for advancing the banding presser means into engagement with the banding material on opposite sides of the stack at the banding station when the stack is at the banding station, means for cutting a section of the strip of banding material from the remainder thereof to provide a second end portion for overlapping the first mentioned end portion, means for depositing glue on one of the end portions in position for overlapping by the other of the end portions, a pair of hand members mounted for advancing adjacent a fourth side of the stack and against the first and second end portions, means for advancing one of the hand members against the glue carrying end portion to advance the glue carrying end portion into overlying relation to said fourth side of the stack, means for moving the other hand member against the other of the end portions to cause the other end portion to overlay the glue and the glue carrying end portion, a stack extraction assembly engageable with the stack at the banding station, means for moving the extraction assembly in a direction to discharge the stack from the banding station when the pusher member advances a subsequent stack from the input station to the banding station, the extraction assembly including discharge presser means engageable with the banding material on opposite sides of the stack to hold the stack under compression as the stack is discharged from the banding station, retractable backstop means for engagement with the banding material at a face of the stack between said opposite sides and opposed to the pusher member when the pusher member advances the stack to the limit of its advance to the banding station and the extraction assembly is at a discharge position, and means for retracting the backstop means when the extraction assembly is away from the discharge position.

2. A machine for wrapping a band around a stack of flat articles which comprises a band guiding assembly and a clamp assembly at a banding station, means for advancing an end portion of a strip of banding material from the band guiding assembly to the clamp assembly, clamp means mounted on the clamp assembly, means for closing the clamp means on the end portion of the strip of banding material, means for separating the clamp assembly from the band guiding assembly to provide an exposed section of the strip of banding material, pusher means for advancing the stack against the exposed section of the strip of banding material to draw the banding material around three sides of the stack, retractable backstop means engageable by the strip opposite the pusher means to hold the strip of banding material when the stack reaches the banding station, means for cutting a section of the strip of banding material from the remainder thereof to provide a second end portion for overlapping the first mentioned end portion at a fourth side of the stack, means for depositing glue on one of the end portions in position for overlapping by the other of the end portions, a pair of hand members mounted for advancing adjacent the fourth side of the stack and against the first and second end portions, means for advancing one of the hand members against the glue carrying end portion to advance the glue carrying end portion into overlying relation to said fourth side of the stack, means for moving the other hand member against the other of the end portions to cause the other end portion to overlay the glue and the glue carrying end portion, a stack extraction assembly having discharge presser means engageable with the banding material on opposite sides of the stack to hold the stack under compression as the stack is discharged from the banding station, means for moving the extraction assembly in a direction of discharge of the stack from the banding station as the pusher means advances a subsequent stack to the banding station, and means for retracting the backstop means when the extraction assembly is discharging the stack and for advancing the backstop means to advanced position when the extraction assembly reaches the limit of its movement in discharge direction.

3. A machine as in claim 2 which includes banding presser means at the banding station and means for advancing the banding means into engagement with the banding material on opposite sides of the stack at the banding station to compress the stack and for retracting the pusher member when the stack is at the banding station.

4. A machine as in claim 3 which includes means for retracting the banding presser means when the extraction assembly advances the stack in discharge direction.

* * * * *